US005540355A

United States Patent [19]

Hancock et al.

[11] Patent Number: 5,540,355

[45] Date of Patent: Jul. 30, 1996

[54] WATER COOLER AND DISPENSING SYSTEM

[75] Inventors: Mark W. Hancock, Los Angeles; Spencer MacKay, Agoura Hills; Yongky Muljadi, Simi Valley; Glenn Inn, San Mateo, all of Calif.

[73] Assignee: Water Chef, Scottsdale, Ariz.

[21] Appl. No.: 998,784

[22] Filed: Dec. 28, 1992

Related U.S. Application Data

[63] Continuation of Ser. No. 852,087, Jul. 26, 1992, abandoned, which is a continuation of Ser. No. 603,811, Oct. 24, 1990, abandoned.

[51] Int. Cl.[6] ..... B67D 5/08; B67D 5/62

[52] U.S. Cl. ..... 222/56; 62/394; 222/63; 222/64; 222/146.6; 222/400.8; 222/642; 222/464.5; 222/189.1

[58] Field of Search ..... 222/56, 63, 64, 222/66, 67, 68, 146.6, 189, 394, 399, 400.7, 400.8, 464, 23; 62/390, 391, 392, 394

[56] References Cited

U.S. PATENT DOCUMENTS

| | | | |
|---|---|---|---|
| 3,269,143 | 8/1966 | Gasparovich | 62/394 X |
| 3,495,612 | 2/1970 | Moreland, II et al. | 62/394 X |
| 3,558,013 | 1/1971 | Ponzo et al. | 222/146.6 X |
| 3,572,553 | 3/1971 | Ogden | 222/67 |
| 3,584,472 | 6/1971 | Sholtes | 62/394 |
| 3,777,937 | 12/1973 | Buck | 222/641 |
| 3,969,909 | 7/1976 | Barto et al. | 222/56 X |
| 4,030,634 | 6/1977 | Osborn | 222/56 X |
| 4,124,146 | 11/1978 | Sealfon | 222/641 |
| 4,153,181 | 5/1979 | Parker et al. | 222/400.8 X |
| 4,174,743 | 11/1979 | Beny et al. | 222/56 X |
| 4,207,994 | 6/1980 | Offlee, Sr. | 222/63 X |
| 4,216,879 | 8/1980 | McMillin | 222/146.6 X |
| 4,364,493 | 12/1982 | Raynes | 222/399 |
| 4,456,149 | 6/1984 | Sciortino | 222/63 X |
| 4,544,084 | 10/1985 | Cleland | 222/56 |
| 4,560,089 | 12/1985 | McMillin et al. | 222/67 X |
| 4,694,975 | 9/1987 | Hagan | 222/464 X |
| 4,958,747 | 9/1990 | Sheets | 222/67 |

*Primary Examiner*—Kevin P. Shaver
*Attorney, Agent, or Firm*—Greg T. Sueoka

[57] ABSTRACT

A water cooler and dispensing system comprises a housing, a pump, a cap, a siphon tube, a reservoir, a cooling unit, control circuitry and a faucet. The housing includes a frame and detachable panels for supporting the reservoir above a water bottle. The cap substantially seals the bottle and is coupled to the pump. The pump forces air into the bottle and water upward through the siphon tube to the reservoir. A liquid pumping system may also be used. The reservoir is divided into two portions, and the lower portion contains a cooling unit for chilling the water. The reservoir has an output port from each portion of the reservoir coupled to a faucet formed by a manifold, two valves and a nozzle. The dispenser also includes control circuitry for selectively operating the pump to maintain a predetermined water level in the reservoir. The controller also lights an indicator when the bottle is empty.

19 Claims, 15 Drawing Sheets

WATER COOLER AND DISPENSING SYSTEM

This application is a continuation of U.S. Ser. No. 852,087, filed Jul. 26, 1992, now abandoned, which is a continuation of U.S. Ser. No. 603,811, filed Oct. 24, 1990, now abandoned.

BACKGROUND OF THE INVENTION

1. Field of the Invention

This invention relates generally to water dispensers, and in particular, to drinking water dispensers for bottled water in which the bottle remains below the dispensing port during operation.

2. Description of the Prior Art

Bottled drinking water is widely used in offices and homes throughout the world. The water coolers and dispensers predominantly in use consist of a stand for holding the water bottle in an inverted position, a reservoir, a faucet and tubing to couple the faucet to the reservoir. Typically the stands are several feet high and the water bottle is placed in an inverted position on the top of the stand. The water bottles vary in size, but typically can hold three to six gallons of water. Loading the bottle of water onto the stand requires removing the cap from the bottle, lifting the bottle to a height greater than the stand, inverting the bottle and placing it on the stand. Since a gallon of water weighs over eight pounds, a standard five gallon water bottle can weigh up to 50 pounds. Thus, simply loading the water bottle on the stand can be difficult and in some cases impossible for many individuals. In addition to the inconvenience of placing the bottle on the stand, there is significant risk of injury or breakage from lifting the unwieldly water bottle. During the inversion and placement of the water bottle on the stand, water often spills which creates further inconvenience and risk of injury. Thus, there is a need for a water dispensing system that eliminates the dangers and difficulties associated with water dispensers using inverted water bottles.

Water dispensing systems directed to this problem are disclosed in U.S. Pat. Nos. 4,030,634 and 4,174,743 to Osborne and Beny, et al., respectively. These patents disclose retrofit devices for standard water dispensers designed to eliminate the need to place the water bottle on the stand in an inverted position. However, while eliminating the need to lift a bottle of water for use, these devices have added problems. One problem is the inability of these devices to remove all water from the bottle. Small amounts of water remaining in the bottle are wasted and an inconvenience to the user. The sanitary condition of the dispenser also continues to be a problem. When replacing water bottles, the tubing that siphons water from the bottle must be removed from the empty bottle and inserted into the full replacement bottle. Neither device provides a sanitary holder for the tube, thus the tube may contact the floor or other unsanitary surfaces during the bottle replacement process. A further problem is control of the pump required to transport the water from the water bottle to the reservoir. Once the bottle is empty, the pump continues to run wasting electricity and creating unwanted noise. Moreover, the pump may continue to run for extended periods of time because the devices do not clearly indicate when the bottle is empty and only indicate that the pump is running. Finally, the devices of Osborne and Beny, et al., do not provide a compact sized dispensing system including refrigeration which allows facile transport within existing bottle distribution systems.

Another problem with water dispensing systems of the prior art is that the dispensers are difficult to clean, repair and refurbish. Since the dispensers output water for human consumption, the ability to maintain the dispensers in a proper sanitary condition is critical. However, the dispensers presently available are difficult to disassemble for cleaning and other maintenance. This is particularly important because the dispensers are commonly leased by bottled water companies to households or businesses. The lease period averages less than a year and the dispensers often require refurbishing before they can be leased again.

SUMMARY OF THE INVENTION

The present invention overcomes these problems with an improved water cooler and dispensing system. The preferred embodiment of the water cooler and dispensing system comprises a housing, a pump, a cap, a siphon tube, a reservoir, a cooling unit, a controller and a faucet. The housing can be easily taken apart for cleaning because it is formed of detachable panels. However, the housing is strong and a handle may be attached for easy transportation of the dispenser. The housing includes a holder for the siphon tube to maintain sanitary conditions when replacing the bottle. The housing also includes a shelf assembly that supports the reservoir and provides snap mounting of the valves of the faucet. The housing holds a water bottle and the other components for dispensing the liquid in the bottle. Preferably, the bottle is positioned in the bottom of the housing with the other components of the dispenser positioned above the bottle.

A cap is placed on the bottle and creates a substantially airtight seal that allows the bottle to be pressurized. The cap provides an inlet that is coupled to the pump and air filter for pumping clear air into the bottle. The cap also has an outlet that is coupled to a siphon tube on the interior of the bottle and conduit on the exterior of the bottle. The siphon tube has adjustable length that extends to and contacts the bottom of the bottle. Thus, air pressure applied to the bottle forces water upward through the siphon tube and out of the bottle. The conduit on the exterior is fluidly coupled to the reservoir for transporting water from the bottle to the reservoir.

The reservoir is divided into two portions, and the lower portion contains a cooling unit for chilling the water. The reservoir has two output ports coupled to conduits which are connected to a faucet formed of a manifold, two valves and a nozzle. One output comes from each portion of the reservoir thereby providing chilled or ambient temperature (relatively unchilled) water.

The dispenser also includes an electronic controller for maintaining a predetermined water level in the reservoir. The controller is coupled to receive input from level switches which indicate if the level in the reservoir is below a minimum, and from a liquid detector which indicates whether there is water in the bottle. The controller activates the pump when the level switches detect a low water level and the bottle is not empty. The controller also activates an indicator when the bottle is empty as determined by the liquid detector. A reset switch is also connected to the controller for initializing the dispenser when an empty bottle is replaced.

DETAILED DESCRIPTION OF THE PREFERRED EMBODIMENT

Figure 1:
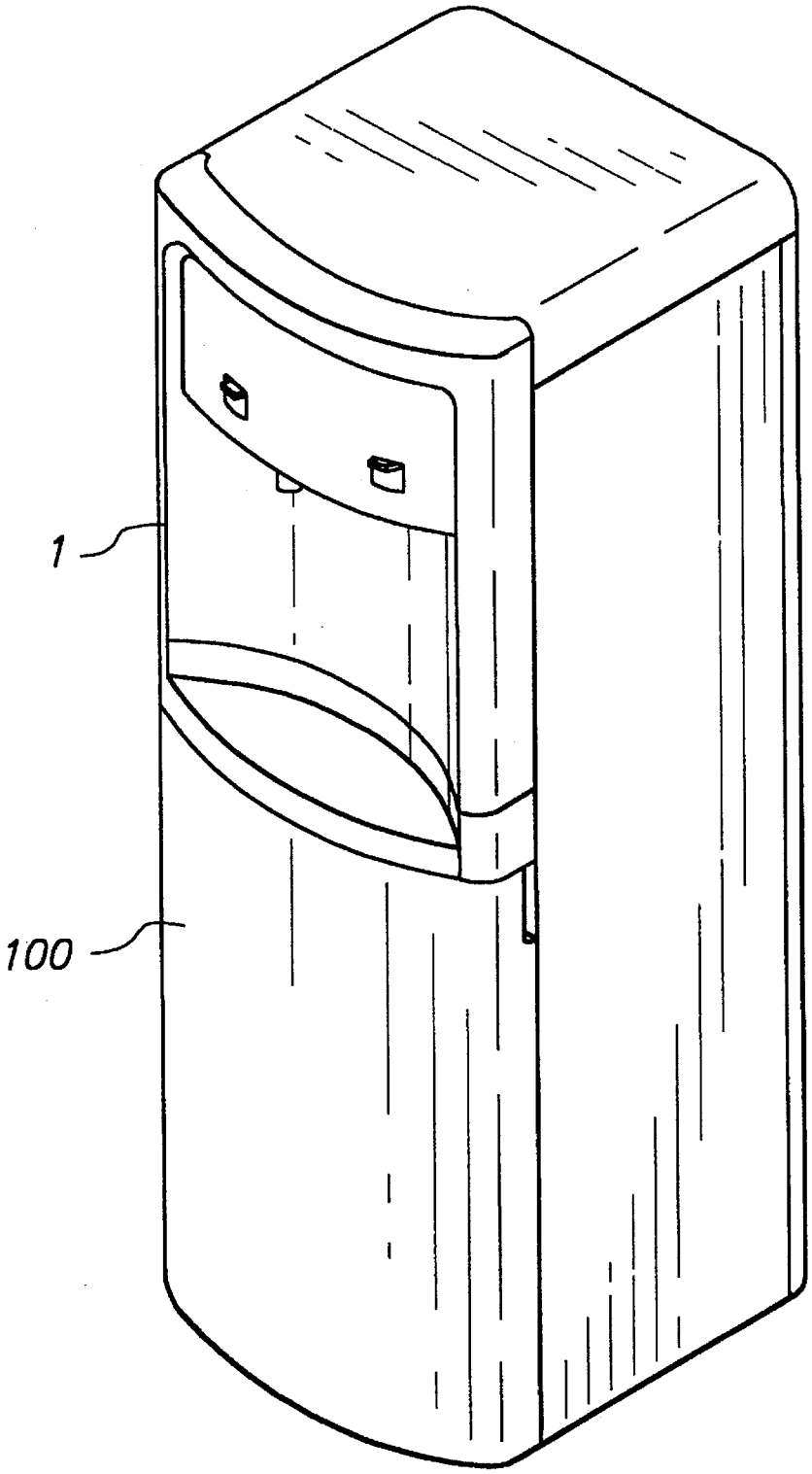
FIG. 1 is a perspective view of the preferred embodiment of the water cooler and dispensing system of the present invention.
Figure 2:
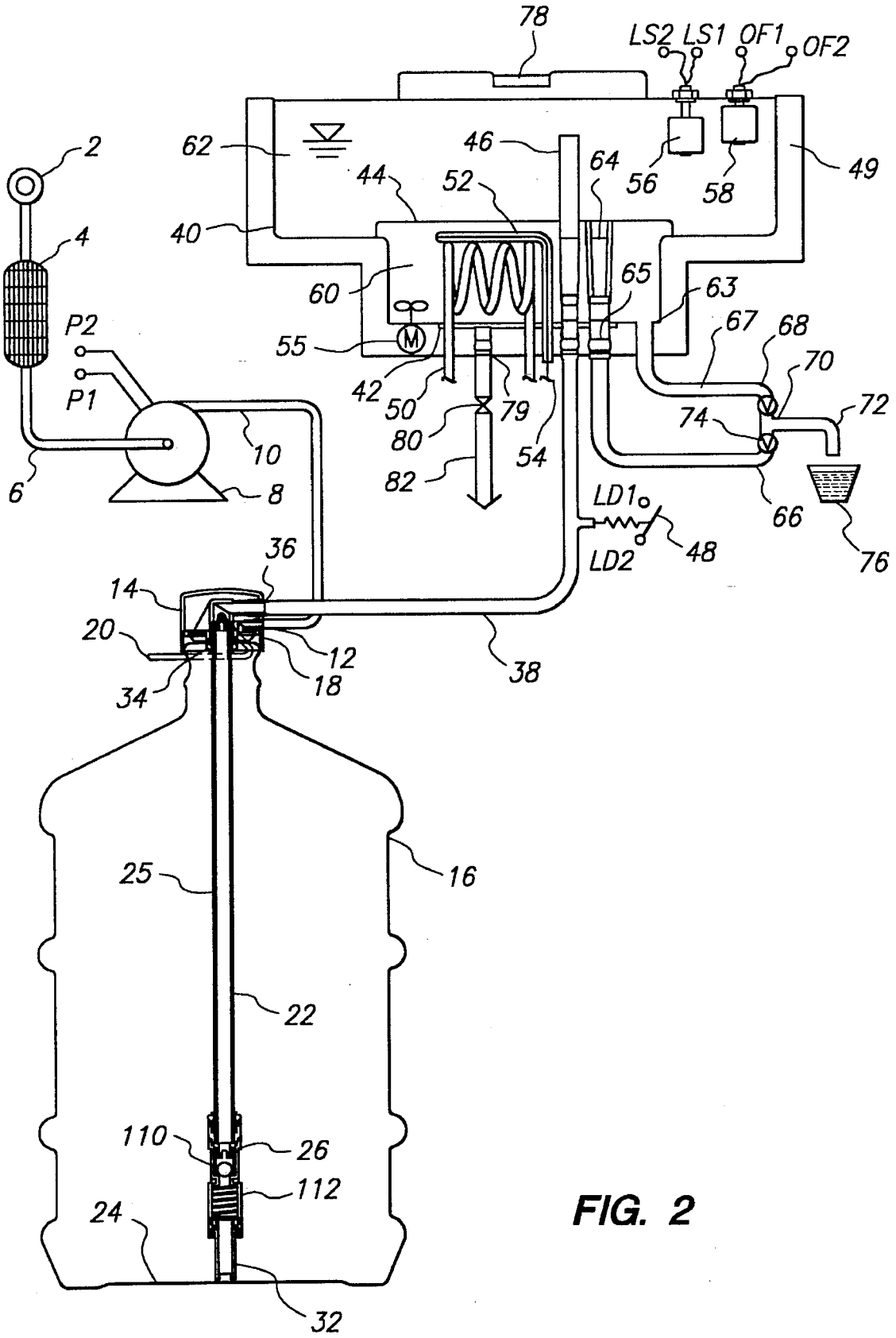
FIG. 2 is a schematic diagram of the preferred embodiment of the present invention.

The present invention is an improved water cooler and dispenser 1 that eliminates the need to lift and to invert a water bottle 16 for use. The dispenser 1 has an exterior defined by a generally rectangular shaped housing 100, as illustrated in FIG. 1. Referring also to FIG. 2, the housing 100 holds the water bottle 16 and the components of the dispenser 1. In a preferred embodiment, the dispenser 1 of the present invention comprises: a pump 8, a cap 14, a siphon tube 22, a conduit 38, a reservoir 40, a cooling element 50, dispensing valves 68, 74, a nozzle 72 and control circuitry 84. The water bottle 16 is advantageously placed at the bottom of the dispenser 1. Water is pumped from the bottle 16 into the reservoir 40 which is disposed near the top portion of the dispenser 1. Once in the reservoir 40, the water is cooled by cooling element 50. Cooling may be supplied by any means known in the art including but not limited to liquid evaporation, absorption and thermoelectric. The water can then be removed from the reservoir 40 through nozzle 72 using the dispensing valves 68, 74.

Referring now to the schematic diagram of FIG. 2, a preferred embodiment of the present invention will be described with particularity. The present invention moves water from the bottle 16 to the reservoir 40 by pumping air into the bottle 16 and forcing water upward through the siphon tube 22 and the conduit 38. The present invention includes an atmospheric air inlet 2 that passes air to a filter 4, a conduit 6, and the pump 8. A filter 4 may be designed to remove airborne particles and/or vapor contaminants as well known in the art. While the filter 4 is shown and described herein as being positioned before the pump 8, it should be understood that the filter 4 may also be interposed between the pump 8 and the cap 14. The use of an air pump 8 is advantageous because of its low cost and its potential to remove all or substantially all of the water from the bottle 16 as hereinafter described. The pump 8 may be one like those presently commercially available and used for aquariums or structurally similar embodiments thereof. The output of the pump 8 is coupled to a conduit 10 that carries pressurized air to the cap 14.

In an alternate embodiment, a liquid pump as known to those skilled in the art can be used instead of the air pump 8. The liquid pump does not require pressurization of the bottle 16 to remove water, therefore, there is less stress on the bottle 16. The liquid pump is preferably self-priming which avoids the need for the user to prime or initialize the system. In such an embodiment, the need for a check valve 110 as will be discussed below is eliminated. The liquid pump would be interposed along the conduit 38 between the bottle 16 and the reservoir 40. In such an alternate embodiment, the bottle cap 14 is provided with an air inlet which is preferably provided with a filter equivalent to the filter 4 for the air pump 8 to prevent airborne contamination of the fluid in the bottle 16 as liquid is removed.

Figure 3:
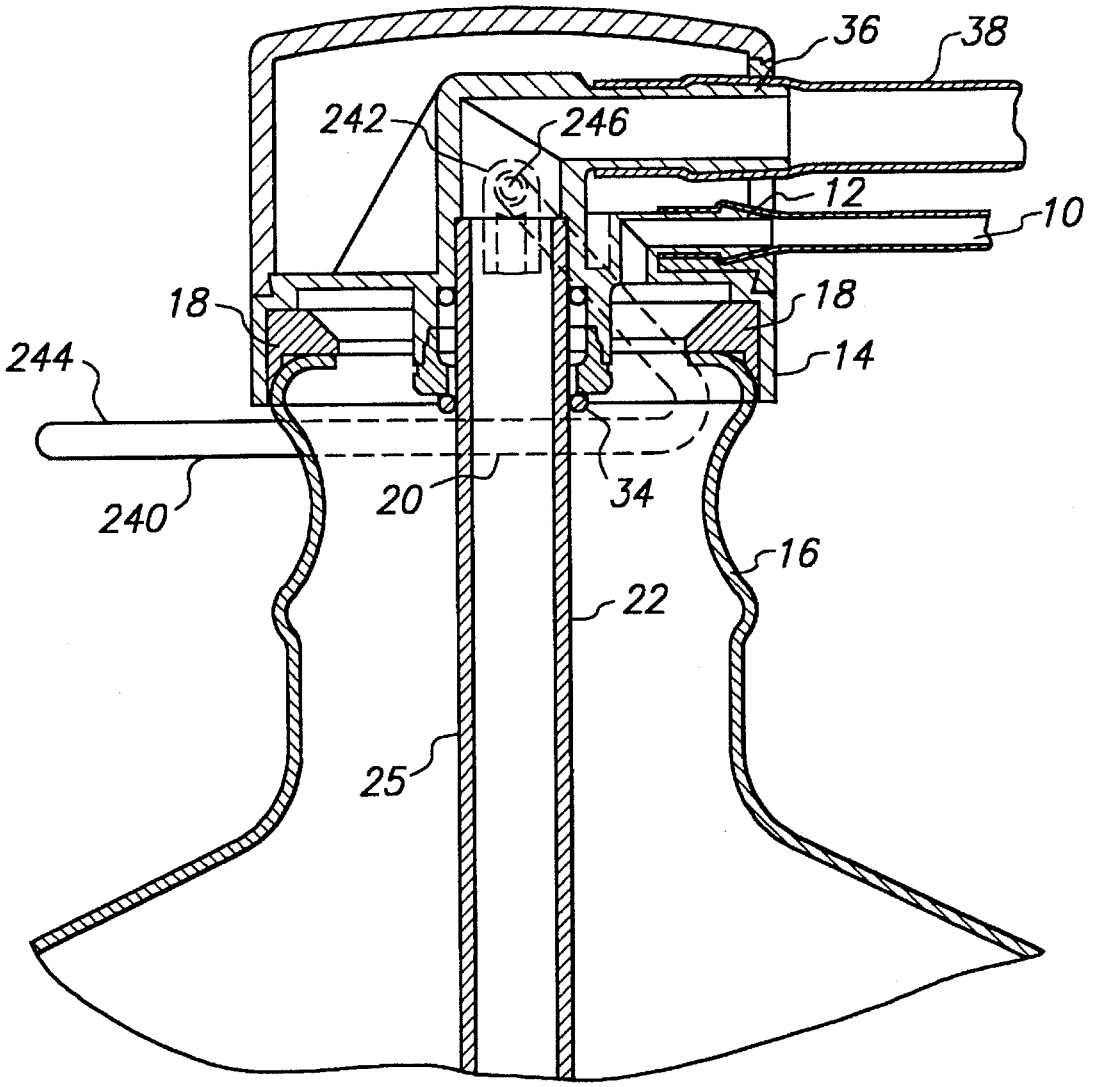
FIG. 3 is a partial cross-sectional view of a cap of the present invention attached to a water bottle.

The cap 14 is sized to form a substantially air tight seal about the opening of the bottle 16 as best illustrated in FIG. 3. A pair of clamp arms 20 are attached to the cap 14 and make contact with the lip (mouth, sidewalls and/or top) of the bottle 16 to force the cap 14 and bottle 16 together. Also, a gasket 18 is positioned between the interior surface of the cap 14 and the lip, as defined above, of the bottle 16 to assure that a substantially air tight seal is formed. The cap 14 allows the bottle 16 to be pressurized so that the bottle's contents will be forced out by any air pressure applied. The cap 14 also provides an input port 12 and an output port 36 for fluid flow through and out of the bottle 16. The input port 12 is coupled to the conduit 10 and opens into the bottle 16 through the cap 14, thereby connecting the pump 8 to the inside of the bottle 16 for pressurization. The output port 36 is coupled to the conduit 38 for outputting water to the reservoir 40 in response to operation of the pump 8. On the interior of the cap 14, a third port 34 is provided. This port 34 is coupled to the siphon tube 22 which extends toward a bottom 24 of bottle 16. Port 34 is preferably of the type sold by John Guest, U.S.A., making first tube 25 removable for cleaning and replacement.

Figure 4:
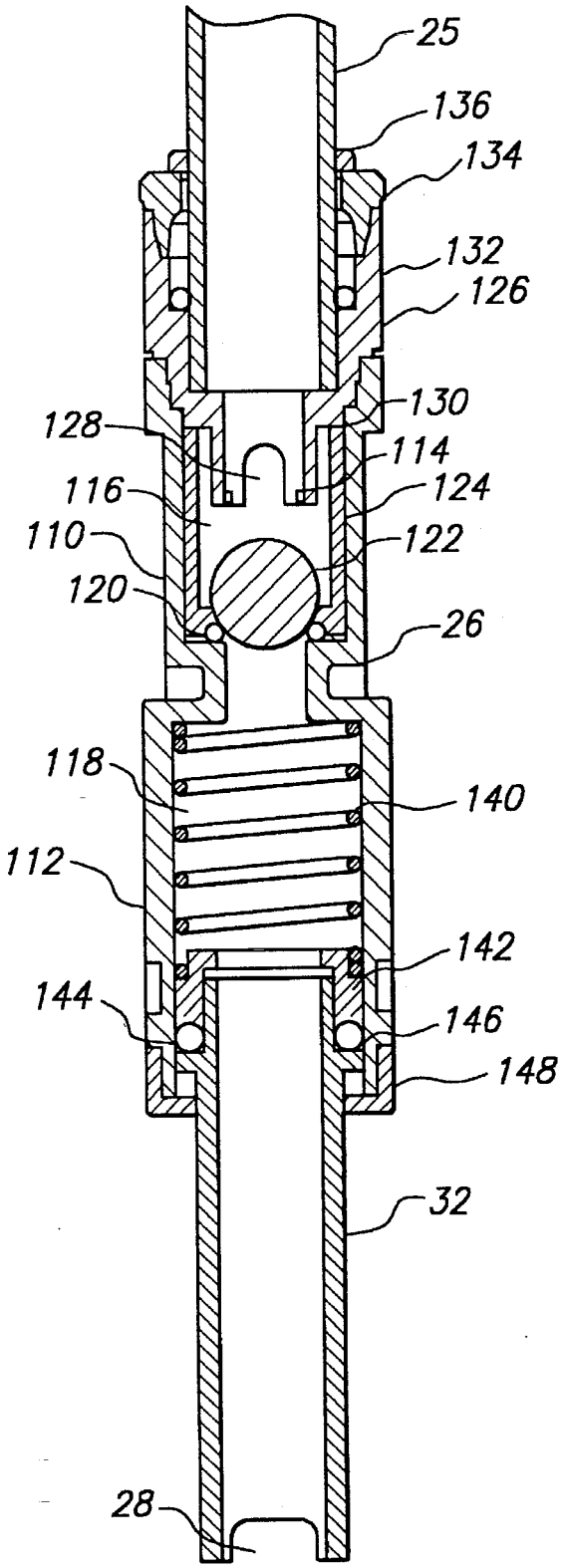
FIG. 4 is a partial cross-sectional view of a preferred embodiment of a housing for the depth compensator of the present invention.

As shown in FIGS. 2 and 4, the siphon tube 22 preferably comprises a first tube 25, an extendible second tube 32 and a housing 26. The housing 26 advantageously allows the length of the siphon tube 22 to vary according to the depth of the bottle 16. This is particularly advantageous because water bottles have various sizes (depths) and the extendibility of the siphon tube 22 allows for compensation of such varying depths. Water remaining in the bottle when it empties is thus minimized. Additionally, the extendible tube 32 is able to compensate for any deflection of the bottom 24 of the bottle 16 due to the air pressure applied to force the water toward the reservoir 40.

The first tube 25 couples the third port 34 to the housing 26. The housing 26 couples the first tube 25 to the second tube 32. Although housing 26 is shown located near the bottom 24 of bottle 16, housing 26 may be fabricated in an elongated embodiment where lower portion 112 is lengthened. Extendible tube 32 may be similarly lengthened and the amount of depth compensation of the system increased.

For example, a single siphon tube 22 with an elongated housing 26 and extendible tube 32 has been fabricated which accommodates 3, 5 and 6 gallon standard plastic water bottles. The free end of the second tube 32 is provided with slots or notches 28 which permit entry of water into the second tube 32 when the free end of the siphon tube 32 is positioned flush with the bottom 24 of the bottle 16. The first and second tubes 25, 32 are preferably rigid tubing. It should be understood that all the tubes 25, 32, 22 and other components are preferably made of materials that are FDA approved as being compatible with potable water.

As best shown in FIG. 4, the housing 26 which connects the first and second tubes 25, 32 may contain both a check valve 110 and a depth compensator 112. The housing 26 shown comprises an upper chamber 116 and a lower chamber 118 for containing check valve and depth compensator components, respectively. The check valve 110 advantageously prevents water that has been pumped upward beyond the housing 26 from flowing back into the bottle 16. The check valve 110 preferably has minimal friction loss so that the pressure needed to lift water to the reservoir 40, and stress on the bottle 16 is also minimized. Since overfilling the reservoir 40 has been linked to friction losses in the fluid delivery system, there is further reason to minimize friction loss across the check valve 110. As the phenomenon is best understood, high check valve cracking and operating pressure differentials (e.g., 2 PSI) result in a bottle pressure which is a minimum of 2 PSI plus the height of the water column defined by the height of the riser tube 46 less the height of water in the bottle 16. Typically, the worst case (bottle empty) water column height in the present invention is below a 42" water column. Assuming zero friction loss in the siphon tube 22 and delivery tubing to the reservoir 40, there will be an excess pressure in the bottle 16 of 2 PSI. Assuming a water bottle having a total volume of 5.0 gallons, 0.75 gallons of water remains in the bottle when the pump 8 stops, 35" water column in the siphon tube/reservoir delivery systems; and further assuming that the pressure equilibrates over time and neglecting tubing volumes, it can be shown by applying Boyle's Law in the form of $P_1V_1=P_2V_2$ that about two liters of water will transfer from the bottle 16 to the reservoir 40 after the pumping cycle stops. Theory-predicted overfilling of the reservoir 40 is in line with experimental results.

Overfilling of a reservoir 40 can be linked not only to the friction loss across the check valve 110, but also to friction loss in the fluid delivery pathway between the bottom 24 and the riser tube 46. It is therefore desirable to design the fluid delivery system for near zero friction loss at rated fluid flows. Alternately, as will be seen by those skilled in the art, the location of the level switch/sensor 56 may be modified to compensate for overfill. This election, however, can reduce the capacity of the reservoir 40 when the water bottle 16 is near full.

The check valve 110 includes an O-ring seal 120, a ball 122, a sleeve 124, and a housing cap 126. The sleeve 124 fits tightly within the walls of the upper chamber 116 and holds the O-ring 120 against the bottom of the upper chamber 116 to form a seal. The inner areas of the O-ring 120 contact the ball 124 to form a water tight seal that prevents water from flowing down through the housing 26 and into the bottle 16. The top end of the upper chamber 116 is covered by the housing cap 126. The housing cap 126 has a stepped shape which is adapted to mate with the upper chamber 116 to force the sleeve 124 and the O-ring 120 against the bottom of the upper chamber 116. The housing cap 126 contacts the housing 26 and the sleeve 124 to seal off the upper chamber 116. The stepped joint in FIG. 4 is designed for sonic welding. At a bottom end 130, the housing cap 126 has a pair of notches 128 which provide a path for water to flow through when the ball 122 is forced against the bottom end 130 as water begins to flow upward through the siphon tube 22. The ball 122 has a diameter less than the diameter of the sleeve 124, but greater than the diameter of the bottom end 130 so that the ball 122 will not be forced out of the upper chamber 116 by the flow of water in either direction. Also, the ball 122 is preferably made of material with a density greater than water so that gravity will drive the ball 122 downward when the upper chamber 116 is filled with water. A step 114 may be provided for retaining a light spring (not shown) to assist sealing. However, such a spring may increase fluid friction as referred to above. An effective seal has been made with a stainless steel ball alone. Sleeve 124 may include internal ribs (not shown) to restrict lateral movement and chattering noise created by turbulent movement of ball 122.

The other end of the housing cap 126 is adapted to receive an end of the first tube 25. Additionally, the housing cap 126 provides an area for an O-ring 132, a cap 134 and a collet 136. The O-ring 132, cap 134 and collet 136 fit about the end of the first tube to couple and seal the first tube 25 and the housing cap 126 together. Fittings of the type shown including a collet 136, a sonic cap 134 and O-ring 132, are known in the art and are distributed by John Guest, U.S.A. An important feature of fittings of this type is that they are easily removable by pressing down on the collet 136 while moving the fitting, i.e., housing 26, away from the tube, i.e., first tube 25. Thus, housing 26 may be removed for cleaning. It should be understood that the check valve 110 may be other types of check valves such as those that use diaphragms as known in the art.

The housing 26 also defines a depth compensator 112 having a chamber 118. The depth compensator 112 allows the length of the siphon tube 22 to be varied by sliding the second tube 32 into the housing 26, in particular chamber 118, to adjust the length of the siphon tube 22 to the bottle 16. A preferred embodiment of the compensator 112 comprises a spring 140, a floating retainer 142, an O-ring 144, and a cap 148. The spring 140 is sized to fit within chamber 118, and is positioned about the longitudinal axis of the housing 26 inside chamber 118. The spring 140 engages the upper end of chamber 118 and resists the movement of retainer 142, and thus, second tube 32 in toward the upper chamber 116. The floating retainer 142 has a generally cylindrical shape with an outer diameter slightly less than the diameter of chamber 118. The second tube 32 has a flange 146 near one end which is placed in close contact with O-ring 144 by the pressure of the spring 140 against floating retainer 142. A seal is thus created regardless of the slidable position of second tube 32 in chamber 118. The purpose of the floating retainer 142 is to reduce O-ring set and seizing which can occur with standard static O-ring grooves. The retainer 142, O-ring 144 and second tube 32 are held within chamber 118 by the cap 148 that is mounted on the lower end of the housing 26. The cap 148 has an aperture through which the second tube 32 extends into chamber 118. The aperture is sized for a minimal clearance fit with second tube 32 and has a diameter slightly greater than the outer diameter of the second tube 32, but less than the diameter of the flange 146. Thus, the flange 146 also prevents the second tube 32 from being removed from chamber 118. Those skilled in the art will note that check valve 110 and depth compensator 112 may be provided in separate housings outfitted with appropriate fittings. Alternately, the check valve 110 may be incorporated inside depth compensator 112 or omitted in embodiments of the invention where it is not required.

Figure 5:
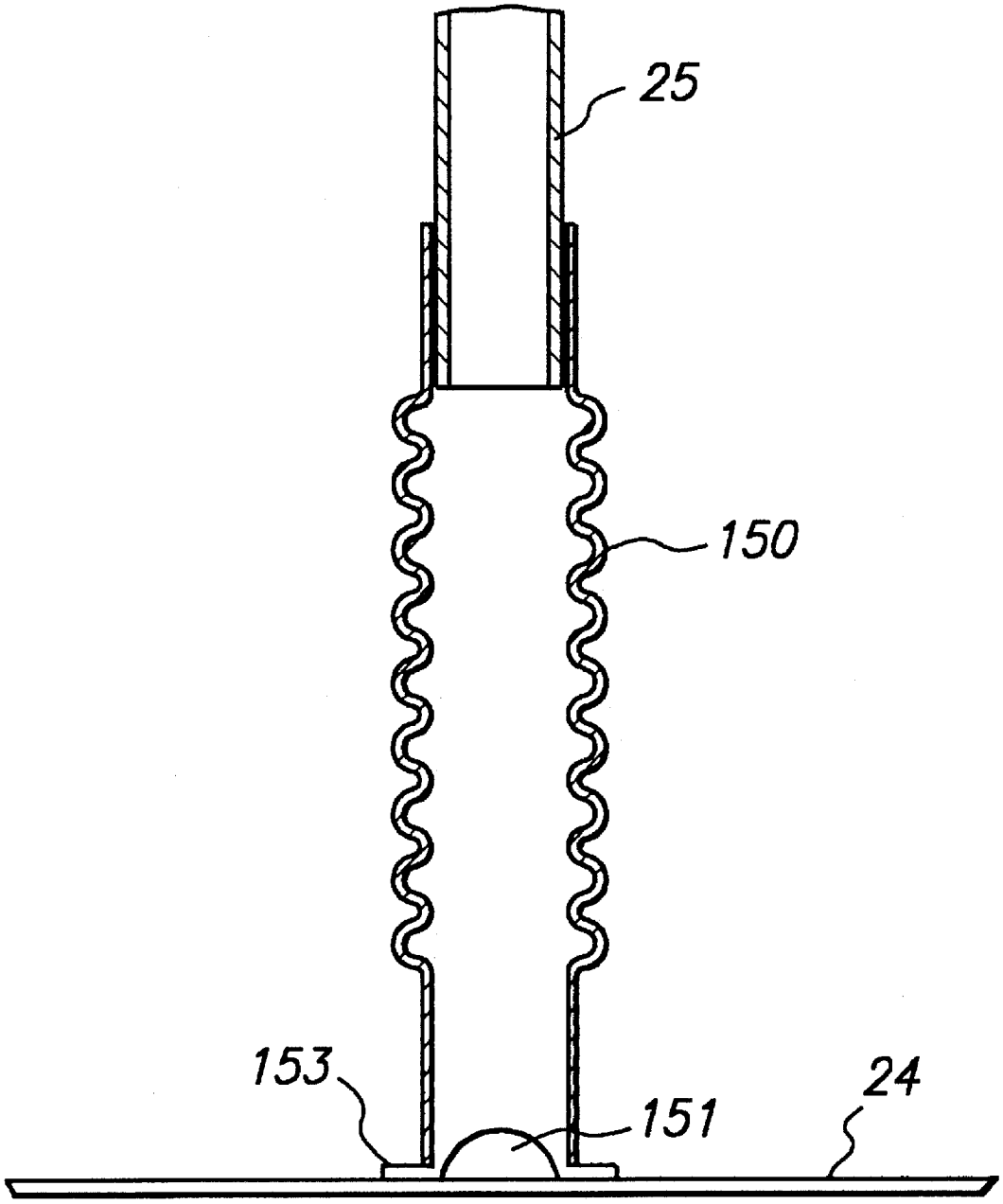
FIG. 5 is a second embodiment of the housing for the depth compensator.
Figure 6:
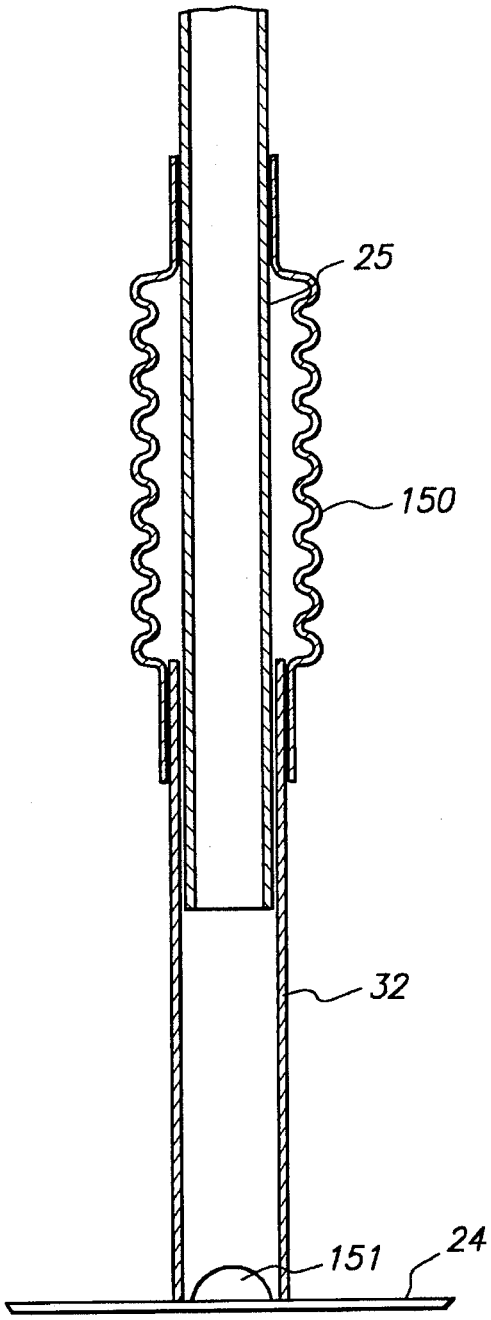
FIG. 6 is a third embodiment of the housing for the depth compensator.

Alternate embodiments of the depth compensator that use a flexible ribbed cylindrical member 150 are illustrated in FIGS. 5 and 6. FIG. 5 shows an alternate depth compensator that eliminates the need for the second tube 32. The ribbed cylindrical member 150 is preferably made of an FDA approved elastomer and is simply attached about the end of the first tube 25. The ribs allow the cylindrical member 150 to be compressed like spring loaded bellows or an accordion to vary the overall length of the siphon tube 22. Member 150 may be spring reinforced if desired. The embodiment shown in FIG. 5 advantageously modifies the end of the cylindrical member 150 with water notches 151 and a flange or flanges 153 so that it can be positioned flush with bottom 24 of the bottle 16. In FIG. 6, another embodiment of the compensator is shown. In FIG. 6, the upper end of the cylindrical member 150 is attached near the lower end of the first tube 25, and the lower end of the cylindrical member 150 is attached to the second tube 32. In this embodiment, the first tube 25 has an outer diameter sized for a close, but low friction, fit within the second tube 32. In the fully extended position the tip of the first tube 25 remains positioned inside the second tube 32. The first tube 25 can slide further into the second tube 32, but such movement is resisted by the cylindrical member 150. It should be understood that the member 150 may be other than cylindrical as may be the tubing to which it connects.

Referring now to FIG. 2, the fluid coupling between the cap 14 and the reservoir 40 by the conduit 38 is illustrated. The conduit 38 is connected to the output port 36 of the cap 14 on one end, and through a bottom plate 42 of the reservoir 40 on the other end. The conduit 38 connects with a riser tube 46 that extends through a baffle 44 and terminates near the top of the reservoir 40. Thus the siphon tube 22, the conduit 38 and the riser tube 46 provide a fluid path from the bottom 24 of the bottle 16 to the top of the reservoir 40. It should be understood that riser tube 46 is preferably disposed just below the water level in reservoir 40. While the fluid path between the bottle 16 and the reservoir 40 has been described as entering from the bottom of the reservoir 40, it should be understood that other paths between the bottle 16 and the reservoir 40 such as those that enter the reservoir 40 from the side may be utilized.

A liquid detector 48 is disposed intermediate bottom 24 and riser tube 46 and preferably at a position intermediate the ends of the conduit 38. The liquid detector 48 is used to indicate whether the bottle 16 is empty by sensing the presence of water (or lack thereof) in the conduit 38. In a preferred embodiment, the liquid detector 48 is an appropriately placed pressure switch that measures the water column pressure in the conduit 38. When air replaces or partially replaces the water column normally present in the conduit 38, the detector 48 signals that the bottle 16 is empty. The liquid detector 48 outputs a signal to control circuitry 84 that operates the pump 8. This assures that the pump 8 will cease operation after the bottle 16 is empty. It should be understood that other liquid detectors known in the art such as a level switch, an optical detector or a sonic detector may be suitably positioned to determine whether the bottle 16 contains any water.

The reservoir 40 holds water received from the bottle 16 for dispensing through a faucet. The exterior of the reservoir 40 is covered with a layer of insulation 49 to protect the water in the reservoir 40 from external temperatures. A baffle 44 may be positioned inside the reservoir 40 to divide the reservoir 40 into a lower portion 60 and an upper portion 62. The baffle 44 provides a thermal/convection barrier between the colder water in the lower portion 60 and warmer water in the upper portion 62. Reservoir 40 is provided with a level switch/sensor 56 and may be provided with an overfill switch/sensor 58. Switches 56, 58 may be directly wired in series in with pump 8 or signal control circuitry 84 to deactivate pump 8 when the water in the reservoir 40 has reached high, normal and overfill levels, respectively. Reservoir 40 is provided with a removable threaded lid which contains an orifice in which a filter 78 is fitted. The filter 78 removes impurities from air that enters the reservoir 40 when water is removed.

The lower portion 60 of the reservoir 40 houses a cooling element 50, which element may be coupled to any refrigeration means known in the art. In the example of FIG. 2, an evaporation coil is shown in direct contact with the water in the lower portion 60 of the reservoir 40. A shell-in-tube configuration, as known in the art, may also be used. A sensor well 52 also extends into the lower portion 60 and is mounted to or near the cooling element 50. The sensor well 52 receives a sensor 54 that is coupled to control the refrigeration means which abducts heat from cooling element 50 and thereby controls the temperature of the water in the lower portion 60 of the reservoir 40. The sensor 54 is preferably a standard capillary-type thermostat probe, however, a thermocouple, thermistor, RTD, or other sensing device known in the art may also be used. The cooling element 50 preferably decreases the temperature of the water in the lower portion 60 of the reservoir 40 such that a quantity of ice is formed about cooling element 50. The sensor 54 may be coupled to a control means to effectively control the temperature and/or amount of ice maintained in reservoir 40. The reservoir 40 may include a mixer 55 to circulate the water therein to increase thermal transfer, and to stabilize the quantity of ice. In such an embodiment, it can be advantageous to remove baffle 44. In this event, it is desirable to direct the outlet tube 46 toward the unchilled output 64 by separate conduit means (not shown). This insures that a large percentage of water dispersed through valve 76 is unchilled (tepid). The present invention, as shown in FIG. 2, advantageously provides positive thermal coupling by mounting the sensor well 52 and the cooling element 50 in the form of a thermal bridge. This prevents cooling element 50 from continuously operating in the event that water or ice is not present in the system.

The reservoir 40 also has three output ports 63, 65, 79 positioned along the bottom plate 42. The first output port 79 couples the lower portion 60 of the reservoir 40 to a drain tube 82. The drain tube 82 allows the reservoir 40 to be drained quickly and easily by service personnel. The drain tube 82 has sufficient length and the output port 79 is located on the bottom plate 42 above the position of the bottle 16 which allows the water in the reservoir 40 to be easily returned to the bottle 16. A drain valve 80 on the drain tube 82 is placed as near to the port 79 as possible, and the drain tube 82 is sized to avoid creating a stagnant area for microbiological activity. The drain valve 78 may be an inexpensive pinch clamp device which creates a seal by closing over soft tubing.

The remaining two output ports 63, 65 provide fluid path to dispense water from the reservoir 40. One port 63 is coupled to a conduit 67 and provides an outlet for cold water from the lower portion 60 of the reservoir 40. The other port 65 provides an outlet for the tepid water in the upper portion 62. This port 65 is coupled on the interior of the reservoir 40 to a tube 64 that extends from the bottom plate 42 through the baffle 44 to the upper portion 62. The tube 64 transports warm water from the upper portion 62 to the port 65. The port 65 is also coupled to the conduit 66 on the exterior of the reservoir 40. The conduits 66, 67 may be coupled together by a manifold 70 which provides an output through a common nozzle 72. Additionally, disposed along the conduits 66, 67 there is a valve 68, 74 respectively, that controls the flow of water to the nozzle 72. Separate cold and tepid dispensing nozzles may also be provided. Further heating of the water from the upper portion 62 of the reservoir 40 may be accomplished by inserting a hot tank (not shown) along the conduit 66. Thus, the dispenser 1 would provide both hot and cold water as well as temperatures in between with control of the valves 68, 74 as desired.

As partially described above the pump 8 is electronically controlled by the control circuitry 84 based on inputs from the liquid detector 48, the level detectors 56, 58 and a reset switch 86. The control circuitry 84 regulates the water level in the reservoir 40 based on the above inputs by selectively outputting the voltage to drive the pump 8. The pump 8 will be switched on by the control circuitry 84 if the water level in the reservoir 40 falls below a minimum as indicated by level switch 56, and there is adequate water pressure as signaled by the liquid detector 48. The control circuitry 84 will also activate the pump 8 if the reset switch 86 is closed and there is inadequate water pressure as indicated by the liquid detector 48. The circuitry will preclude pump 8 from operating in the event an overfill condition is sensed by overfill switch 58. Closing the reset switch 86 operates the pump 8 for a predetermined amount of time to prime (e.g., filling the siphon tube 22 and conduit 38 with water to trigger the liquid detector 48 after replacing an empty water bottle 16) the dispenser 1. The control circuitry 84 also generates a signal that is applied to an indicator lamp 88 when the bottle 16 is empty. In particular, the liquid detector 48 is connected to the indicator lamp 88 to signal when the bottle 16 is empty. The reset switch 86 is preferably a push button switch that is accessible from the exterior of the dispenser so that it may be depressed by the user after a new bottle 16 has been installed in the dispenser 1. Alternatively, the reset switch 86 may be a magnetic proximity switch positioned such that when the water bottle 16 is installed or the lower front panel of the unit is closed, a magnet is forced close to the switch, thereby automatically signaling the control circuitry to prime the dispenser 1. The reset switch may be coupled to sliding actuator 202 or 204 as described below.

Figure 7A:
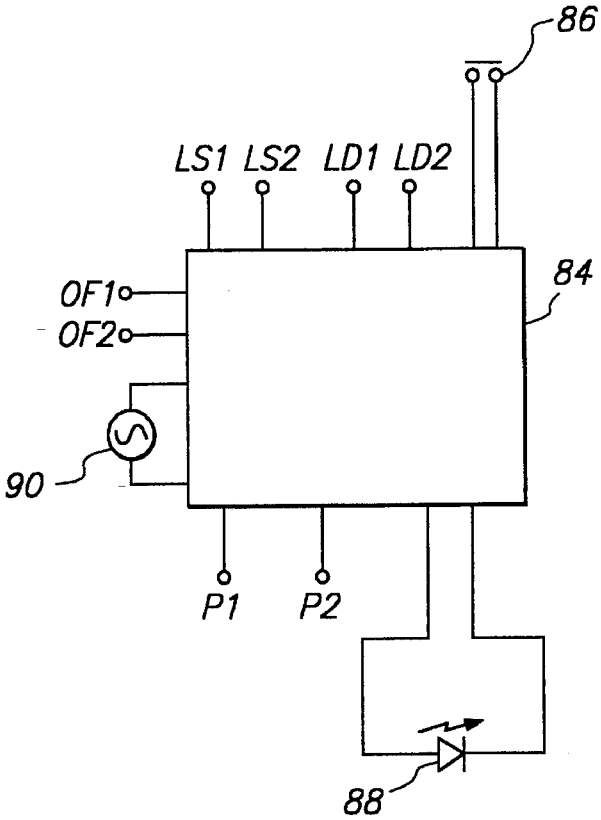
FIG. 7B is a schematic diagram of a preferred embodiment of control circuitry of the present invention.
Figure 7B:
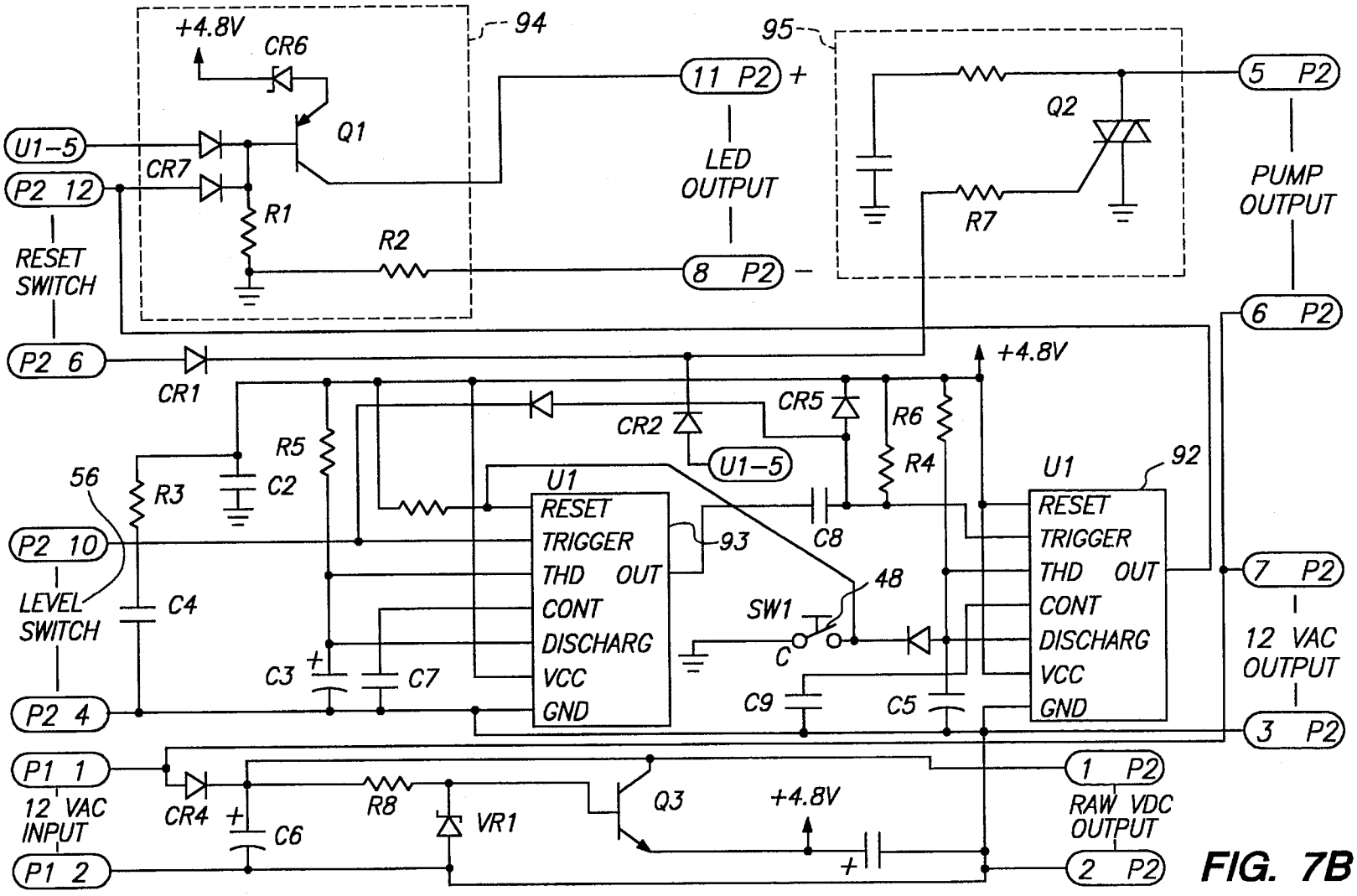

In a preferred embodiment, the control circuit 84 comprises two timers 92, 93, and other discrete components such as resistors and capacitors. The two timers 92, 93 are coupled as described below to alternately power the pump 8. As illustrated in FIG. 7B resistors and capacitors are coupled to the timers 92, 93 so that the timer 93 outputs a 60 second pulse when triggered, as can be understood by one skilled in the art. The reset switch 86 is coupled between the trigger input of the timer 93 and ground. The output of the timer 93 is coupled through a diode CR2 to drive the pump 8. The output of the timer 93 is also coupled to the trigger input of the other timer 92 through the capacitor C8. The reset input of the timer 93 is coupled by the liquid detector or pressure switch 48 to ground. The pressure switch 48 is also coupled through a diode to the threshold and discharge inputs of the other timer 92. The output of the other timer 92 is coupled to the one end of level switch 56 and a lamp indicator circuit 94. The lamp indicator circuit 94 preferably comprises a transistor, diodes, and resistors configured as known to those skilled in the art to supply power to light a light emitting diode (not shown). The other end of the level switch 56 is coupled through a diode CR1 to drive the pump 8. In particular, the level switch 56 and the output of the timer 93 are coupled to a pump drive circuit 95 comprising resistors, a capacitor and a gate switch that control application of power to the pump 8. Overfill switch 58 may be wired in series with one leg of the pump to provide overfill protection.

As described above, the reset switch 86 and the pressure switch 48 are coupled to the timer 93. Initially, the pressure switch 48 will be open since the pump 8 has not been operated to create pressure in the conduit 38. Closing the reset switch 86 causes the output of the timer 93 to become active, and thus, causes the pump 8 to operate. This allows the dispenser 1 to be primed (i.e. pumping water from a new bottle into the conduit 38 so that the dispenser operates automatically). Once water has been pumped into the conduit 38 sufficient to close the pressure switch 48, the timer 93 will be reset since the pressure switch 48 now couples the reset input of the timer to ground, and the pump 8 ceases to be driven by the output of the timer 93. Since the pressure switch 48 is now closed the output of the other timer 92 is active, however, the output of the other timer 92 will drive the pump 8 only if the level switch 56 is closed. The level switch 56 is positioned in the reservoir 40 and will close whenever the water level in the reservoir 40 is less than the desired or predetermined level. Thus, the level switch 56 automatically controls the operation of the pump 8 and maintains the desired level of water in the reservoir 40 as long as the pressure switch 48 is closed. While the control circuitry 84 has been shown and described above as two timers 92, 93 coupled to the pressure, level and reset switches 48, 56, 86, it should be understood that other similar circuits as known to those skilled in the art may be used for the control circuitry 84.

It should be noted by those skilled in the art that circuitry 84 may be provided with components forming a latch which may sense(unlatch) upon momentary opening or closing of liquid detector 48. Such would be the case when a bubble or bubbles having a specific size/time constant pass by liquid detector 48.

Figure 8:
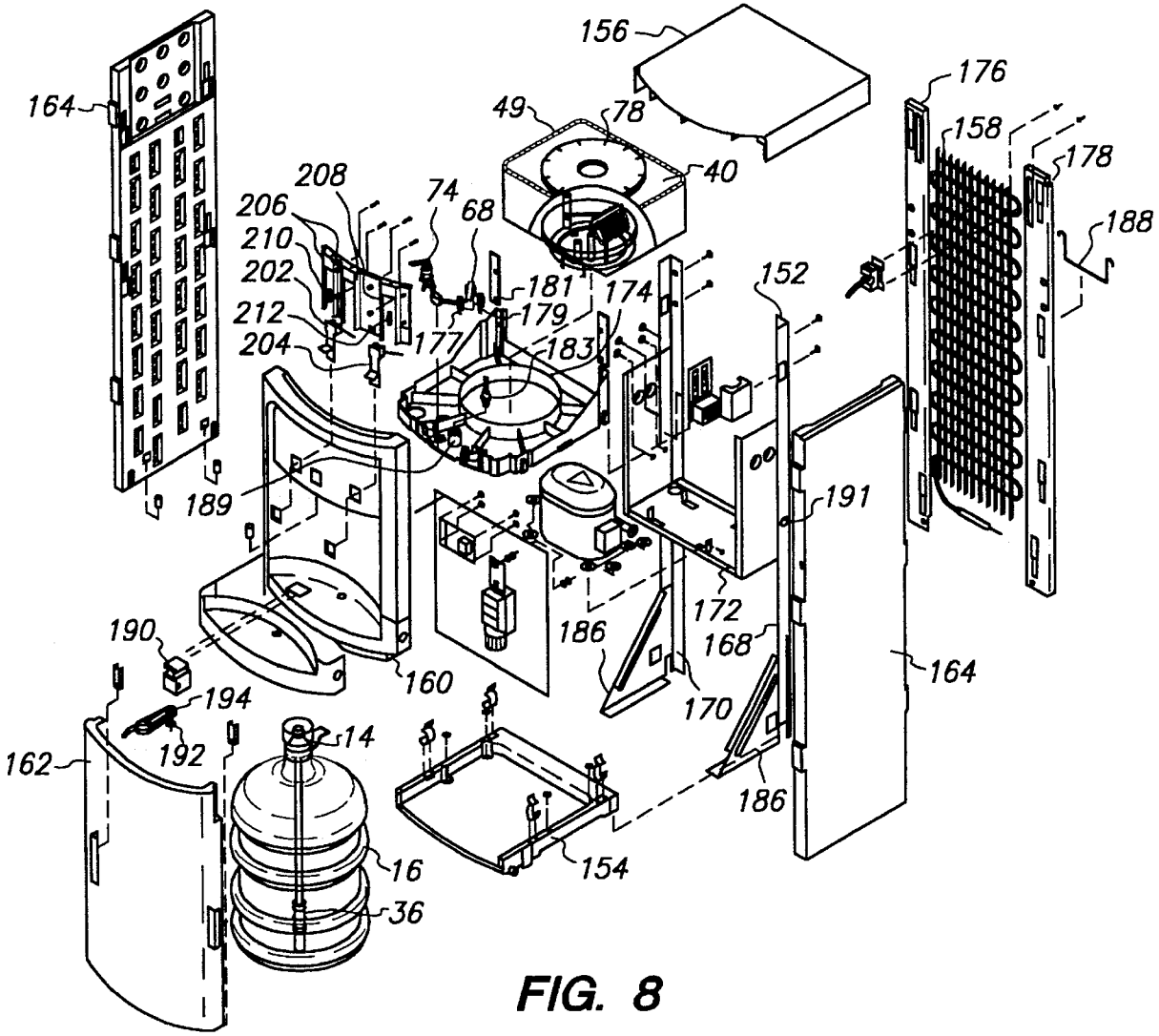
FIG. 8 is an exploded perspective view of the dispenser housing and assembly.

The control circuitry 84, the water bottle 16 and other components described above are advantageously held in the housing 100. As illustrated in FIG. 8, the housing comprises a frame 152, a base 154, a top cover 156, a grill 158, an upper front panel 160, a lower panel 162 and a pair of reversible side panels 164. In the preferred embodiment, the upper front panel 160, the side panels 164, the lower panel 162, the base 154 and the cover 156 are advantageously formed of durable plastic which is easy to clean and refurbish. The frame 152 further comprises a pair of L-shaped brackets 168, 170, a central support 172 and a shelf 174. The L-shaped brackets 168, 170 are mounted parallel to each other on opposite sides of the central support 172 to form the frame 152. The central support 172 preferably has a U-shape with the brackets 168, 170 mounted on opposite legs. The brackets 168, 170 are mounted near their center to the support 172. The shelf 174 is also mounted to the brackets 168, 170 above the central support 172. The shelf 174 supports the reservoir 40. Together these four members 168, 170, 172 and 174 form the rigid frame that support the other components and the panels.

Figure 9:
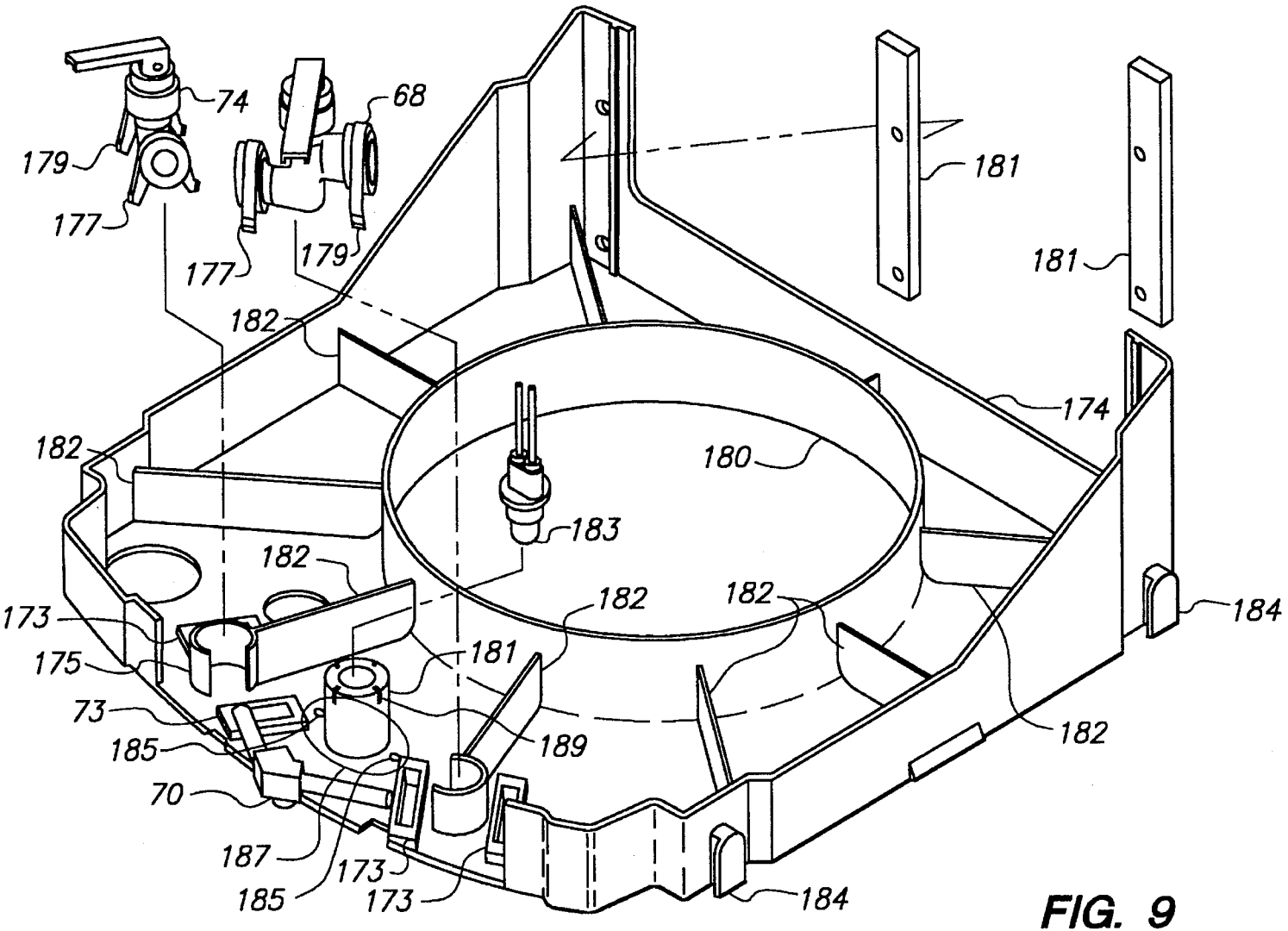
FIG. 9 illustrates an exploded perspective view of shelf assembly.

As illustrated more particularly in FIG. 9, the shelf 174 has a unique structure for supporting the reservoir 40, and valves 68, 74. The shelf 174 preferably has a rectangular pan shape and preferably is made in one piece from molded plastic. In the center of the shelf 174 there is a circular aperture defined by a ring 180. The aperture is provided to accommodate the lower portion 60 of the reservoir 40. Along its bottom edge, the ring 180 is connected to the shelf 174. This provides added support about the edges that define the aperture. The walls of the shelf 174 are also connected to the ring 180 by ribs 182 for further support. Toward the rear of the shelf 174 the walls rise for mounting on the brackets 168, 170. Plates 181 having holes matched to those in the rear walls of shelf 174 may be provided to reinforce the attachment of shelf 174 to the brackets 168, 170. On the sides of shelf 174, dove tail lugs 184 are provided to mount the side panels 164. In between lugs 184 on the sides of the shelf, triangular protrusions 214 are provided to guide the side panels 164 when they are being fitted onto the lugs 184. Near the front of the shelf 174, an area is provided for mounting the valves 68, 74, which in turn connects manifold 70 and conduits 67, 66, respectively. On the surface of the shelf 174, there is a semi-cylindrical member 175 to accommodate each valve 66, 67. On the sides of each semi-cylindrical member 175, two slots are defined by rectangular protrusions 173 on the surface of the shelf 174. The semi-circular members 175 and their associated protrusions 173 advantageously allow the valves 68, 74 to be snapped into place or removed without tools. Snaps 177, 179 which attach to each valve 68, 74 provide a means of securing shelf 174. The shelf 174 is also provided with an integral reflector 181 for housing a lamp 183. Further, a pair of lugs 185 on the underside of shelf 174 provide mounting means for a lens 187. Since lamp 183 is positioned to shine a spot of light directly into the displacing area and the vessel being filled, lens 187 provides protection against glass entering the dispensing area or vessel in the event lamp 183 should accidentally break. Slots 189 in reflector 181 provide means to carry away heat generated from the lamp 183.

Figure 11:
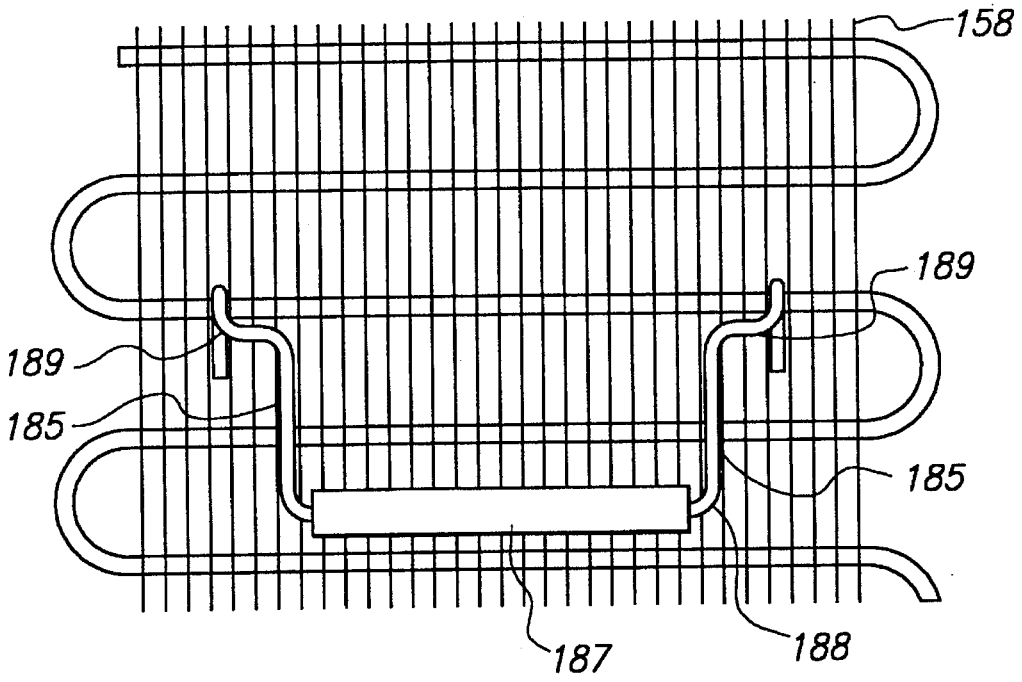
FIGS. 11, 11A and 11B illustrate a partial rear and side elevation views of the rear grill with a handle attached.
Figure 11A:
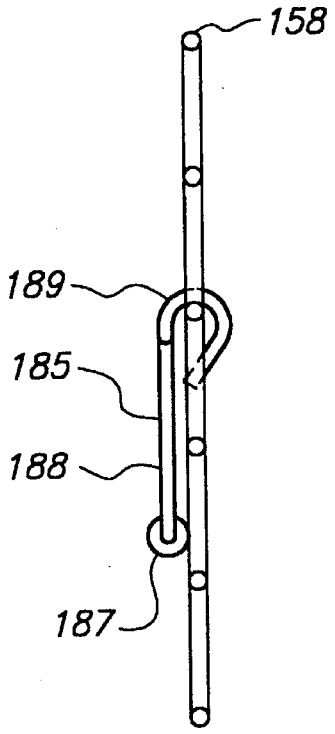
Figure 11B:
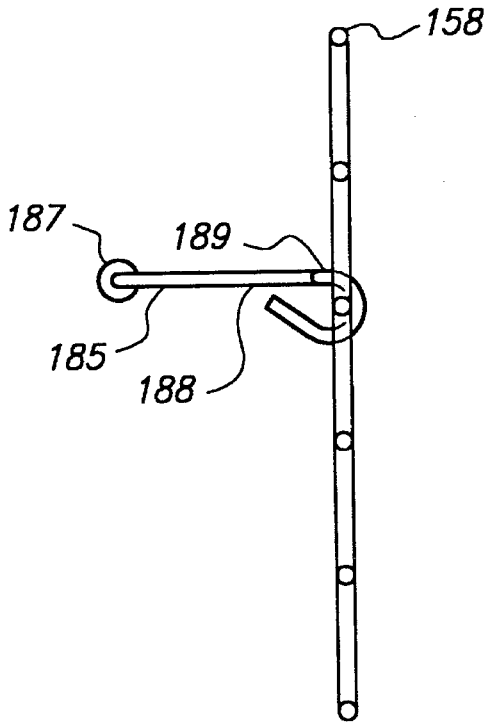

Referring now to FIG. 8, the parts attached to the frame 152 are shown. At the bottom of each bracket 168, 170, a triangular member 186 is attached. The triangular members 186 support the frame 152 vertically and attach the frame 152 to base 154. The base 154 is preferably mounted to the frame 152 with screws that mate with the triangular members 186. Also, attached to the frame 152 is the grill 158. The grill 158 is formed from the condenser coil that is attached and reinforced by a plurality of rods. The grill 158 is mounted on the rear of the frame 152 and has longitudinal edges that parallel the brackets 168, 170. It should be understood that the grill 158 is rigidly mounted to the frame 152 and may be considered part of the frame 152 just as the brackets 168, 170. As illustrated in FIG. 11, the grill 158, in particular, the coil and rods can support the entire weight of the dispenser 1 and a handle 188 may be attached to the grill 158 for lifting and moving the dispenser 1. The handle 188 comprises a longitudinal grasping section 187 and a pair of extension arms 185 formed to pivot about the coil so that when the dispenser 1 is not being transported, the handle 188 can lay flat against grill 158 as best illustrated in FIG. 11A. When the dispenser 1 is being lifted by handle 188, handle 188 advantageously rotates only until extension arms 185 are perpendicular to the plane formed by the grill 158 and the support struts 189 contact the grill 158. As best illustrated in FIG. 11B, rotation of handle 188 is limited by the support struts 189 so that the user's hand will not be pressed against the grill 158. The handle 188 is preferably manufactured from heavy gage wire. The grasping area 187 may be a plastic or foam tube fit over the wire before forming or provided in split form after the wire form is made. Alternatively, the grasping area may be dipped coated plastic by means known in the art. In short, the grip area if used may be provided in any known form so that lifting the dispenser 1 is as comfortable as possible to the ungloved hand. The embodiment of the handle 188 as shown in FIGS. 11A and 11B shows a closed loop around a bare condenser coil. It may also be supplied in an open loop U-shaped to form for easy assembly/disassembly. Further, the condenser coil may be protected by a plastic sleeve or grommet.

Also, attached to the frame 152 is a set of rear molding columns 176, 178 that parallel the brackets 168, 170. Each column 176, 178 is attached to a respective bracket 170, 168. The columns 176, 178 have slots for receiving tabs of the side panels 164. The tabs on the rear edge of the side panels 164 fit into the slots in the columns 176, 178. The side panels 164 also have slots that fit on the mating lugs 184 of the shelf 174 and the base 154 for mounting thereto. The side panels 164 are additionally mounted to the base 154 using clips that are inserted into openings near the bottom of the side panels 164. Similar to the columns 176, 178, the lower panel 162 has two clips for attachment to the lower tabs on the front edge of the side panels 164. Upper front panel 160, like the lower panel 162, is completely supported by the side panels 164. The upper front panel 160 has apertures on its rear side for mating with the two upper tabs along the front edge of the side panels. The side panels also have a notch between the upper tabs to secure a protrusion on the rear side of the upper front panel 160 and position the upper front panel 160 vertically. The top cover 156 fits over the side panels 164 and mates with upper front panel 160 to securely position the top cover 156 on top of the dispenser 1. While the attachment of the side panel 164, front panel 160, cover 156 and frame 152, have been described with particular fastening means, it should be understood to those skilled in the art that other fastening means may be used.

Figure 10:
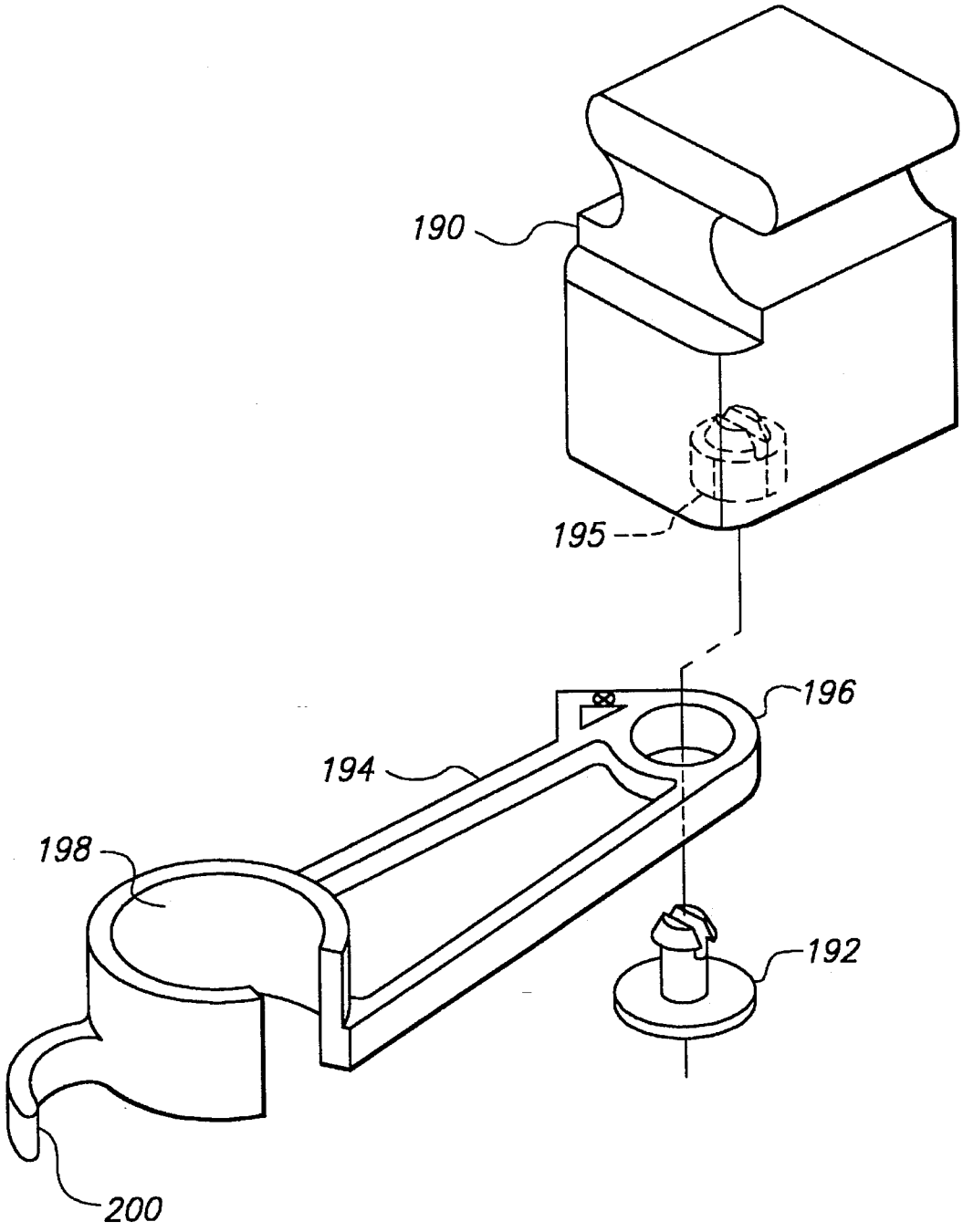
FIG. 10 is an exploded perspective view of the siphon tube holder and attachment.

The upper front panel 160 has a curved shape that provides an area on the bottom side for mounting a support member 190. This positions the support member 190 inside the dispenser 1 hidden from view. As illustrated in FIG. 10, the support member 190 has an aperture 195 on the bottom for receiving a pin 192. The pin 192 is used to fasten a holder 194 and acts as an axle about which the holder 194 rotates. The holder 194 preferably has a ring 196 to facilitate attachment to the pin 192. The ring 196 is connected by a pair of arms to a C-shaped member 198. The C-shaped member 198 is preferably sized to hold the siphon tube 22. In particular, the C-shaped member 198 must provide a gap greater than the diameter of the siphon tube 22 so that the cap 14 can rest on the C-shaped member 198 with the siphon tube extending down through the C-shaped member 198. Additionally, a handle 200 is provided to swing the holder 194 out from under the upper front panel 160. In the preferred embodiment the siphon tube 22 does not touch the floor, cooler, or other unsanitary surfaces when suspended in the C-shaped member 198. It should be noted that pin 192 and aperture 195 are designed so that if excessive downward pressure is placed on member 198, pin 192 will come out of aperture 195 before any other part of the assembly breaks.

Figure 12:
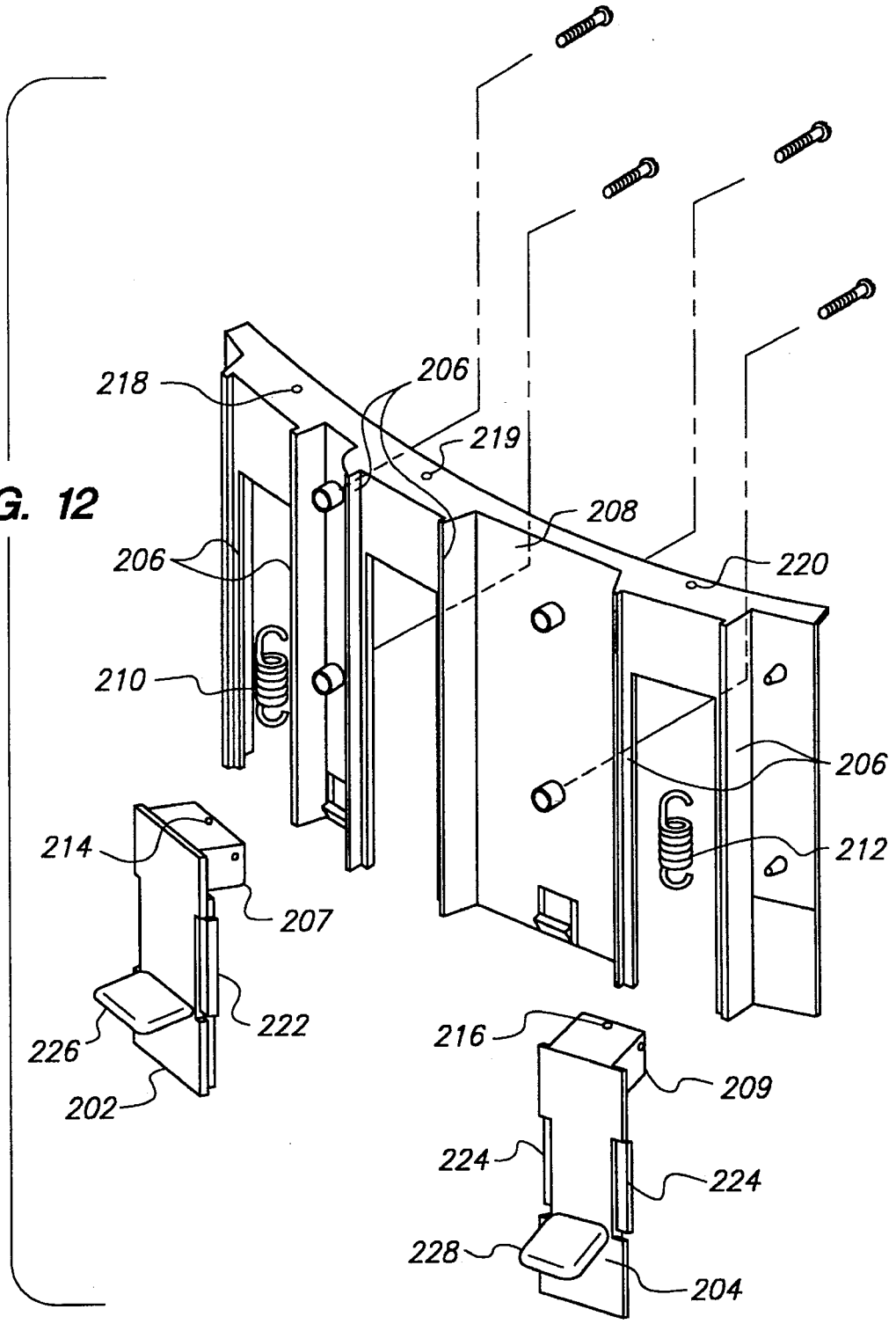
FIG. 12 is an exploded perspective view of the sliding valves and the backing sheet of the present invention.

The upper front panel 160 also acts as a base for mounting slider guide 208. The sliding actuators 202, 204 are mounted in a tracks formed by slots 206 on the slider guide 208. As shown in FIGS. 8 and 12, the sliding actuators 202, 204 have a generally planar rectangular shape with levers 226, 228 on the front and engagement portions 207, 209 on the rear. The sliding actuators 202, 204 may be coupled to springs 210 through holes 214, 216 respectively. The springs 210, 212 are attached between the sliding actuators 202, 204 and the holes 218, 220 in the top portion of slider guide 208. Sliding actuators 202, 204 have respective engagement portions 207, 209 for coupling to the handles of valves 74, 68. The engagement portions 207, 209 preferably captivate the handles so that they cannot rotate out of position once engaged. Thus, by forcing the sliding actuator 202, 204 downward, the handle of the corresponding valve 74, 68 moves downward to open the valve 74, 68 and allow water to flow from the reservoir 40 to the nozzle 72. Springs 210, 212 assist the springs in the valves for a positive return. The slider guide 208 is preferably fastened to the upper front panel 160 using screws and thereby locking the sliding actuators 202, 204 in the slots 206. The sliding actuators 202, 204 are particularly advantageous because they are very user friendly since the user simply depresses the levers to dispense water from the reservoir 40. The sliding actuators 202, 204 are also advantageous because they incorporate tracks 222, 224, levers 226, 228, holes 218, 220 all in a single molded plastic part. Further, slider guide 208 is advantageous because it too can be made in a single molded plastic part. As can be best seen in FIG. 12, slider guide 208 may be fabricated to incorporate 3 sets of slots 206 for holding 3 sliding actuators 202, 204, (and one not shown). Thus dispenser 1 may include a third, and preferably central sliding dispensing actuator. Thus a hot/cold/tepid dispenser or a hot/carbonated/cold dispenser can be easily fabricated using the same internal slider guide 208 to hold the third sliding actuator. The slots 206 below hole 219 may also be used to captivate a single sliding actuator, for example for cold only dispensing.

Figure 13:
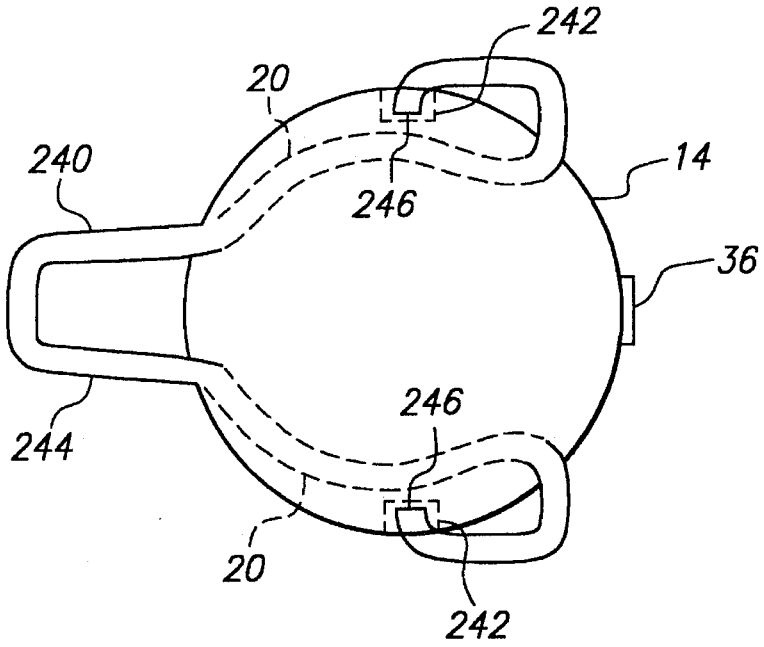
FIG. 13 is a top plan view of a preferred embodiment of the bottle cap of the present invention.

Referring now to FIG. 13, there is shown a top plan view of bottle cap 14 and clamp arms 20. Clamp 240 is preferably a single piece wireform which inserts into molded sockets 242 formed into the cap 14. The wireform has a handle section 244 to increase the mechanical advantage when rotating clamp 240 around pivot points 246. As can be seen more clearly in FIG. 3, the clamp 240 may be applied by placing siphon tube 22 in bottle 16 and rotating clamp 240 in a generally downward motion so that handle 244 and arms 20 come to rest in a generally horizontal plane. As clamp 240 rotates into final position, arms 20 expand outwardly due to the increased diameter of bottle 16 in the travel path of clamp 240. When the clamp 240 comes to rest, it is positioned at or preferably above the mouth of the water bottle 16. This clamping arrangement provides satisfactory sealing on a variety of water bottles manufactured by different companies and having differently shaped necks. This feature is in part due to the flexibility of arms 20 extending from handle 244.

Figure 14A:
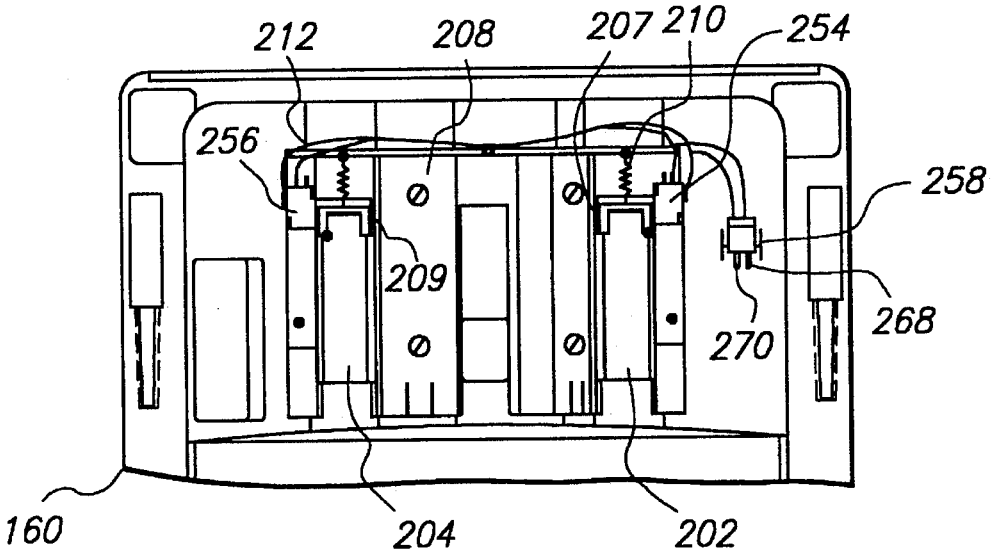
FIG. 14A illustrates a specific switching and valve actuation arrangement for the embodiment of FIG. 14.
Figure 14:
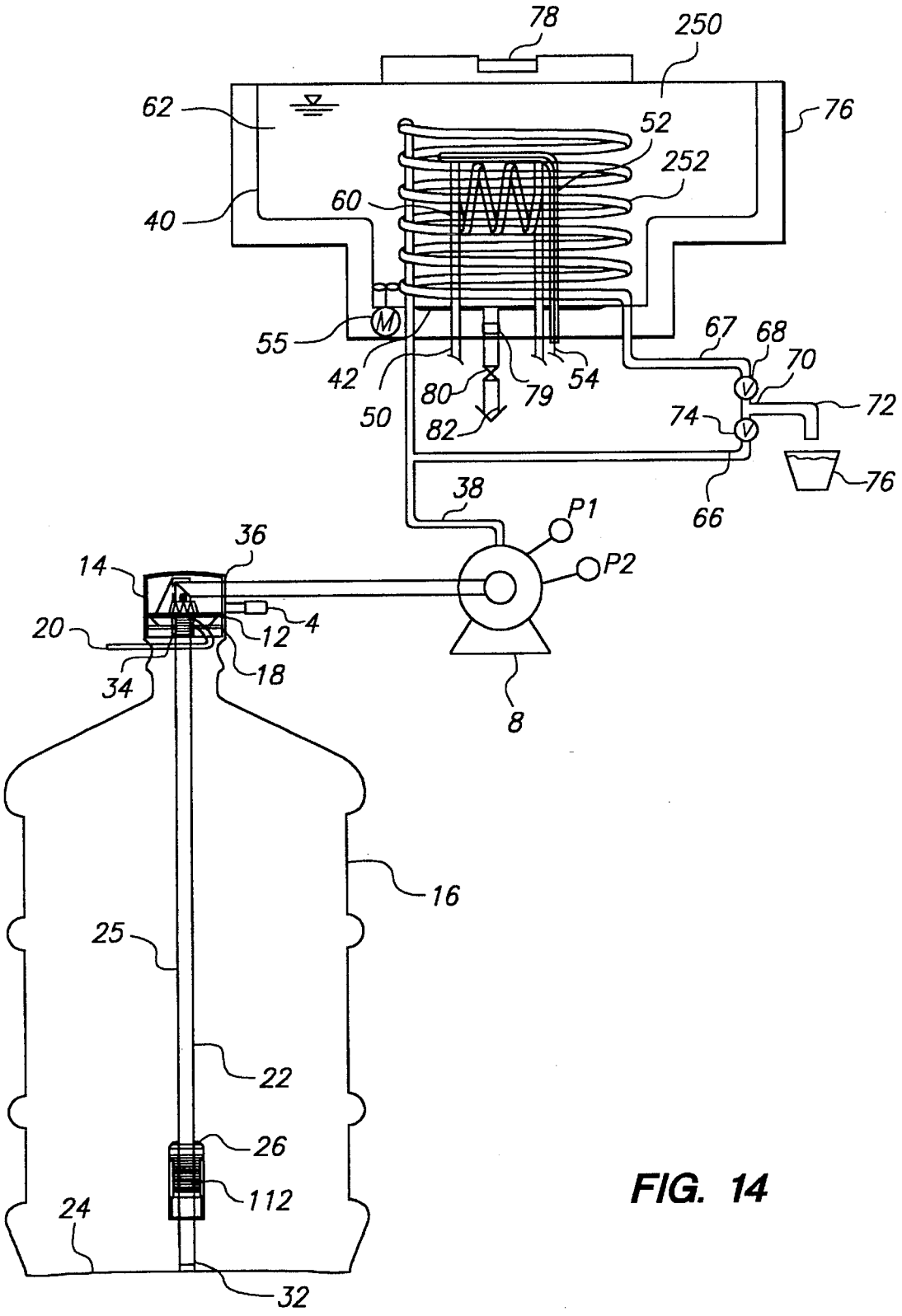
FIG. 14 illustrates a schematic diagram of an alternate embodiment of the water cooler and dispensing system of the present invention.

Referring now to FIG. 14, there is shown an alternate embodiment of the subject invention. In this case pump 8 is a water pump, preferably of the self pumping type whose flow characteristics are preferably matched to the desired dispensing rate. In this embodiment, reservoir 40 is used as an ice bath container only and is not directly in contact with the fluid being dispensed. The ice bath 250 is stirred by mixer 55. In a preferred embodiment, mixer 55 stirs the bath 250 in a circumferential spinning motion to create a flow velocity across cooling coils 252. Cooling coils 252 may be made of copper, or if purified water is to be dispensed, stainless steel or other compatible material. Pump 8 may be activated simultaneously or nearly simultaneously with opening of one or both valves 68, 74. Referring to FIG. 14A, a portion of the internal side of upper front panel 160 is shown. Also shown are slider guide 208, limit switches 254, 256, and electrical connector 258. As indicated above sliding actuators 202, 204 are coupled to the handles of valves 74, 68 respectively. When one of the actuators 202 or 204 is first pressed the valve will open slightly then the roller arm of respective limit switches will cause a contact closure on the pins 268, 270 of connector 258. Switches 256, 258 may be wired in parallel so that if either or both sliding actuator 202,204 are pressed then a contact closure will result. The contact closure at pins 268, 270 can be used to activate pump 8 on demand for dispensing. As can be seen in FIG. 14, tepid water will flow directly from the bottle 16, through pump 8, conduit 66, valve 74 and nozzle 72. Chilled water will flow from bottle 16, pump 8, coil 252, conduit 67, valve 68 and nozzle 72. Note that a filter 4 may be either hidden in or exterior to cap 14 for filtering air entering bottle 16 during dispensing. An air path must be provided for the hidden (disk filter) embodiment of cap 14.

The embodiments of FIG. 2 and 14 each have advantages. The FIG. 2 embodiment has a reserve of dispensable water in the reservoir 40 and an indicator lamp 88 that warns the user that the bottle is empty. Water is still dispensable, however, from reservoir 40 when the lamp 88 first comes on. The embodiment of FIG. 14 is easier to sanitize and does not require the check valve 110. On the other hand, the embodiment of FIG. 14 requires an expensive coil 252 and mixer 55. Electronic control sensors may be added to the configuration of FIG. 14 similar to that in FIG. 2, but this requires added expense. The best configuration may depend on the individual consumer's wishes and willingness to pay for the features available.

Figure 15:
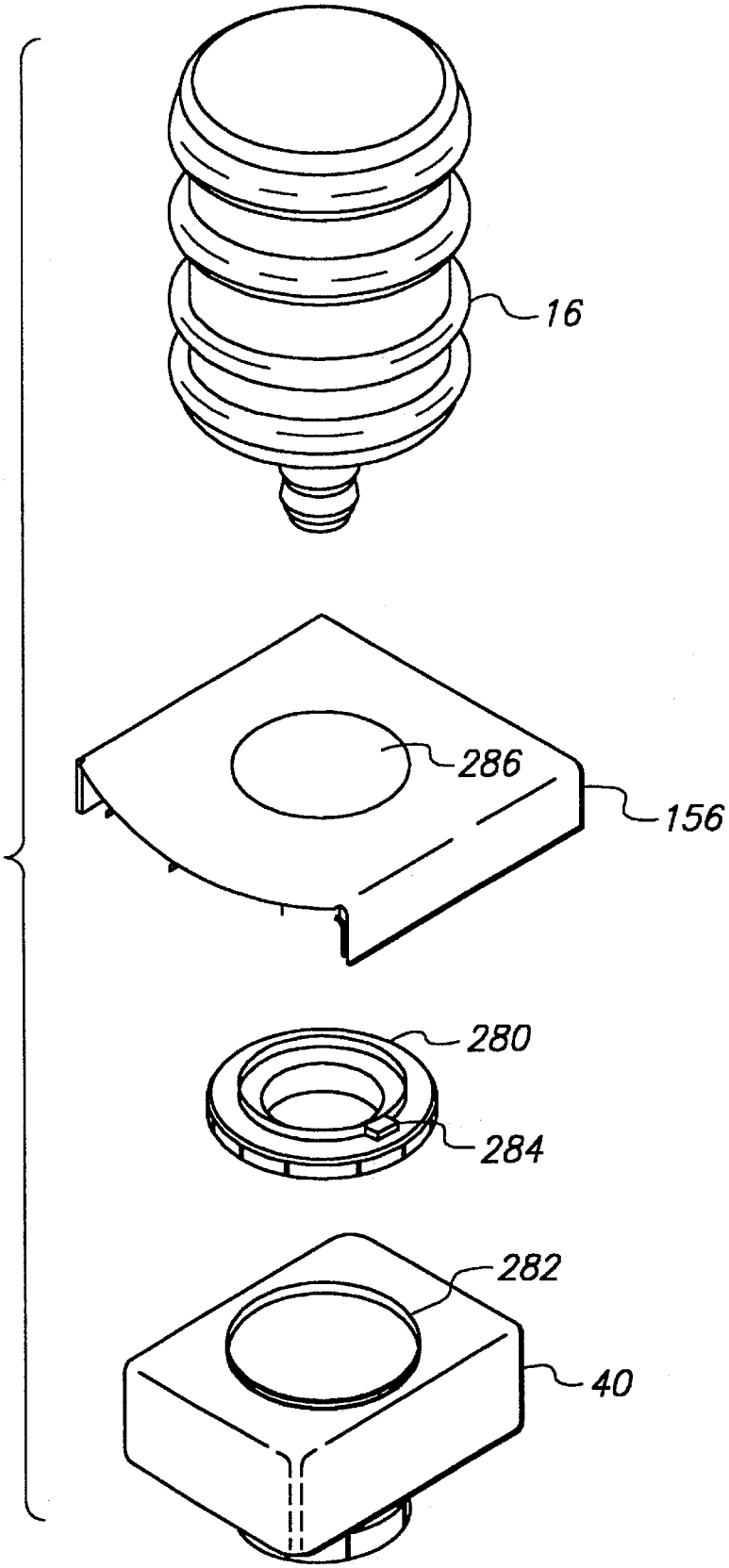
FIG. 15 is an exploded perspective view of an alternate embodiment of the present invention with the bottle disposed above the system.

It has been discovered through market research and consumer testing that there is a small segment of the market which prefers the bottle on top configuration. Cost and full visibility of the water in the bottle are two cited reasons for the preferences. Since the same market research indicates that consumers strongly prefer the styling, height of dispensing, and ease of use of the sliding actuators 202, 204, dispenser 1 is configured to be easily adaptable to a bottle on top embodiment. Referring now to FIG. 15, reservoir 40 is provided with an olla 280. In the preferred embodiment, the olla 280 may be threaded and include a gasket or otherwise fitted to form a substantially air tight seal against mouth 282 of reservoir 40. Additionally, the olla 280 may be provided with a filter 284, as known in the art, to filter air entering the bottle 16 to replace the liquid dispensed or otherwise removed therefrom. Cooler top 156 is provided with an opening 286 to receive bottle 16 and mate with olla 280. This configuration has the added advantage of storing a substantial quantity of water close to the point of use. For example, if the consumer uses 6 gallon bottles, then 6 gallons may be stored in the bottle compartment of dispenser 1. With a 1½ gallon capacity reservoir 40 and a 6 gallon bottle on top, a total of 13½ gallons may be made available to the user near the point of use.

In operation of the embodiment of FIG. 14, the user connects dispenser 1 to a suitable power source and inserts the siphon tube 22 into a new bottle 16 of fluid to be dispensed. Since the siphon tube includes an extendible siphon tube 22, it will generally be necessary for the user to push down slightly on the bottle cap 14 to counteract any resistive force that the extendible siphon tube 22 may create. The handle 240 of the cap 14 is then locked to secure the cap 14 on the bottle 16. It should be noted that the length of the siphon tube 22 automatically compensates for various size bottles. A sliding actuator 202 or 204 is depressed until the pump 8 primes and liquid begins to dispense through nozzle 72. When the bottle 16 is empty, dispensing will cease despite the user pressing the sliding actuators 202 or 204. If provided with electronic circuitry, a lamp may indicate the lack of water in bottle 16.

In operation of the embodiment of FIG. 2, the user connects the dispenser 1 to a suitable power source and inserts the siphon tube 22 into a new bottle 16 of fluid to be dispensed. Since the siphon tube 22 includes an extendible siphon tube 22, it will generally be necessary for the user to push down slightly on the bottle cap 14 to counteract any resistive force that the extendible siphon tube 22 may create. The handle 240 of the cap is then locked to secure the cap 14 on the bottle 16. It should be noted that the length of the siphon tube 22 automatically compensates for various size bottles. The reset switch 86 is then depressed to prime the dispenser 1. The dispenser is then ready for use and will indicate when the bottle needs to be replaced as well as maintain the level of liquid in the reservoir 40. In a dispenser having an overall height of 42¼", approximately 48" water column pressure has been used to lift the water from bottle 16 to reservoir 40.

What is claimed is:

1. An apparatus for dispensing liquid from a container, said apparatus comprising:

a pumping means having a control input for removing liquid from the container in response to a control signal, the pumping means fluidly coupled to the container;

a reservoir having an inlet and a first outlet receiving, dispensing and holding liquid;

a connecting means fluidly coupling the container and the reservoir;

a dispensing means coupled to the reservoir, the dispensing means outputting liquid from the apparatus when activated by a user;

a level sensor having an output for signaling when less than a predetermined amount of liquid is in the reservoir, the level sensor attached to the reservoir;

a liquid detector having an output for generating a signal in response to a substantially empty condition in the container, the liquid detector coupled to the container;

control circuitry having a first and a second input and an output for operating the pumping means when the level sensor indicates less than the predetermined amount of liquid in the reservoir and the liquid detector indicates that the container is not empty, the first input coupled to the output of the level sensor, the second input coupled to the output of the liquid detector, and the output of the control circuitry coupled to the control input of the pumping means; and a housing for enclosing the pumping means, the reservoir, the level sensor, the liquid detector, the control circuitry and the container, the housing maintaining the dispensing means above the container and the reservoir above the dispensing means.

2. The apparatus of claim 1, wherein the pumping means is a liquid pump coupled to and pumping liquid through the connecting means.

3. The apparatus of claim 1, wherein the pumping means further comprises:

a cap having an inlet port, an outlet port, the cap adapted to seal the container for pressurization, the cap mounted on the container and forming a seal with the container and the outlet port of the cap coupled to the connecting means;

an air pump having an inlet and an outlet, for pumping air into the container, the outlet of the air pump coupled to the inlet port of the cap.

4. The apparatus of claim 3, wherein the pumping means further comprises an air filter attached to the inlet of the air pump.

5. The apparatus of claim 3, wherein the connecting means further comprises:

a first tube coupled between the reservoir and the output port of the cap;

a second tube having a first and a second ends, the first end of the second tube coupled to the first tube by the output port of the cap, the second tube extending into the container and having a variable length for positioning the second end of the second tube flush with the container.

6. An apparatus for dispensing liquid from a container, said apparatus comprising:

a pumping means having a control input for removing liquid from the container in response to a control signal, the pumping means fluidly coupled to the container:

a reservoir having an inlet and a first outlet for receiving, dispensing and holding liquid;

a connecting means fluidly coupling the container and the reservoir;

a dispensing means coupled to the reservoir, the dispensing means outputting liquid from the apparatus when activated by a user:

a level sensor having an output for signaling when less than a predetermined amount of liquid is in the reservoir, the level sensor attached to the reservoir;

a liquid detector having an output for generating a signal in response to a substantially empty condition in the container, the liquid detector coupled to the container;

control circuitry having a first and a second input and an output for operating the pumping means when the level sensor indicates less than the predetermined amount of liquid in the reservoir and the liquid detector indicates that the container is not empty, the first input coupled to the output of the level sensor, the second input coupled to the output of the liquid detector, and the output of the control circuitry coupled to the control input of the pumping means;

a baffle mounted inside the reservoir to divide the reservoir into an upper portion and lower portion; and a cooling unit positioned in the lower portion of the reservoir to chill the liquid in the lower portion.

7. The apparatus of claim 6, wherein the cooling unit further comprises a stirring means to circulate the liquid in the lower portion of the reservoir.

8. The apparatus of claim 6, wherein the cooling unit is in direct contact with the liquid in the lower portion of the reservoir and the temperature of the cooling unit is controlled to transform a portion of the liquid near the cooling unit to the liquid's solid form.

9. The apparatus of claim 6, wherein the reservoir further comprises a filter attached in an opening atop the reservoir for allowing air to enter and exit the reservoir as liquid is removed from and placed in the reservoir.

10. The apparatus of claim 6, wherein the reservoir further comprises:

a second outlet for removing liquid from the upper portion of the reservoir; and wherein the first outlet removes liquid from the lower portion of the reservoir.

11. The apparatus of claim 10, wherein the reservoir further comprises a third outlet for removing liquid from the lower portion of the reservoir, the third outlet coupled to a drain tube and a drain valve.

12. The apparatus of claim 10, wherein the dispensing means further comprises:

a first conduit coupled to the first outlet of the reservoir and a first valve positioned on the first conduit to control the flow of liquid through the first conduit;

a second conduit coupled to the second outlet of the reservoir and a second valve positioned on the second conduit to control the flow of liquid through the second conduit;

a manifold having two inlets and an outlet, of the inlets of the manifold coupled to the first and the second conduits; and a nozzle coupled to the outlet of the manifold.

13. An apparatus for dispensing liquid from a container, said apparatus comprising:

a pumping means having a control input for removing liquid from the container in response to a control signal, the pumping means fluidly coupled to the container;

a reservoir having an inlet and a first outlet for receiving, dispensing and holding liquid;

a dispensing means coupled to the reservoir, the dispensing means outputting liquid from the apparatus when activated by a user;

a level sensor having an output for signaling when less than a predetermined amount of liquid is in the reservoir, the level sensor attached to the reservoir;

a liquid detector having an output for generating a signal in response to a substantially empty condition in the container, the liquid detector coupled to the container;

control circuitry having a first and a second input and an output for operating the pumping means when the level sensor indicates less than the predetermined amount of liquid in the reservoir and the liquid detector indicates that the container is not empty, the first input coupled to the output of the level sensor, the second input coupled to the output of the liquid detector, and the output of the control circuitry coupled to the control input of the pumping means;

a first conduit coupled to the reservoir;

a second conduit having a first and a second end, the first end of the second conduit coupled to the first conduit, the second conduit extending into the container and having a variable length for positioning the second end of the second conduit flush with the container, the second conduit comprising:

a first tube;

a second tube having a first end and a second end, the second end having notches which allow liquid flow into the second tube when the second end is flush with the container; and a housing coupled between the first tube and the first end of the second tube, the housing having a check valve permitting liquid flow in only one direction, and a depth compensator defining a chamber to slidably receive the first end of the second tube, the depth compensator having a spring to resist movement of the second tube into the chamber.

14. The apparatus of claim 13, wherein the dispensing means further comprises a conduit coupled to the first outlet of the reservoir and a valve positioned on the conduit to control liquid flow through the conduit.

15. The apparatus of claim 13, wherein the liquid detector is a pressure switch positioned to measure the pressure in the connecting means.

16. The apparatus of claim 13, wherein the control circuitry comprises a timer and discrete components.

17. The apparatus of claim 13, wherein the control circuitry further comprises a reset switch and reset circuitry that operate the pumping means for a predetermined amount of time after the reset switch is closed.

18. The apparatus of claim 13, wherein the control circuitry further comprises an indicator lamp that is lit when the container is substantially empty.

19. An apparatus for removing liquid from a container, comprising:

a first tube;

a second tube having a first end and a second end, the second end having notches which allow the flow of fluid into the second tube when the second end is flush with the container; and a housing coupled between the first tube and the first end of the second tube, the housing having a check valve permitting liquid flow in only one direction, and a depth compensator defining a chamber to slidably receive the first end of the second tube, the depth compensator having a spring to resist the movement of the second tube into the chamber.

* * * * *